US010343006B2

(12) United States Patent
Francis et al.

(10) Patent No.: US 10,343,006 B2
(45) Date of Patent: Jul. 9, 2019

(54) EXERCISE DEVICE AND PRELOADED RESISTANCE PACK

(71) Applicant: SpiraFlex Inc., Kansas City, MO (US)

(72) Inventors: Paul S. Francis, Overbrook, KS (US); Lawrence E. Guerra, Mission, KS (US)

(73) Assignee: SpiraFlex Inc., Kansas City, MO (US)

( * ) Notice: Subject to any disclaimer, the term of this patent is extended or adjusted under 35 U.S.C. 154(b) by 0 days.

(21) Appl. No.: 15/614,118

(22) Filed: Jun. 5, 2017

(65) Prior Publication Data

US 2017/0368401 A1 Dec. 28, 2017

Related U.S. Application Data

(60) Provisional application No. 62/406,697, filed on Oct. 11, 2016, provisional application No. 62/353,909, filed on Jun. 23, 2016.

(51) Int. Cl.
*A63B 21/00* (2006.01)
*A63B 21/04* (2006.01)
(Continued)

(52) U.S. Cl.
CPC .... *A63B 21/0455* (2013.01); *A63B 21/00065* (2013.01); *A63B 21/0435* (2013.01);
(Continued)

(58) Field of Classification Search
CPC ..... A63B 21/0004; A63B 21/00043; A63B 21/00058; A63B 21/00061; A63B 21/00065; A63B 21/00069; A63B 21/00072; A63B 21/00076; A63B 21/002; A63B 21/0023; A63B 21/02; A63B 21/04;
(Continued)

(56) References Cited

U.S. PATENT DOCUMENTS 481,730 A 8/1892 Miller
760,374 A 5/1904 Belvoir
(Continued)

FOREIGN PATENT DOCUMENTS

CN 201603335 10/2010
GB 191506249 9/1915
(Continued)

*Primary Examiner* — Gary D Urbiel Goldner
(74) *Attorney, Agent, or Firm* — Erickson Kernell IP, LLC; Kent R. Erickson

(57) ABSTRACT

A preloaded resistance pack and exercise device. The resistance pack includes an elastomeric resistance element coupled to a hub and disposed on a plate. The hub includes a pair of radially extending wings that lie against a surface of the plate. The plate includes a pair of raised tabs that lie within a rotational path of the wings. An initial rotation of the hub relative to the plate causes the wings to slide over and beyond the raised tabs and at least partially stretches the resistance element. Interaction between the tabs and wings prevents the hub from rotating back to an initial position and maintains the resistance element in a preloaded, tensioned condition. The exercise device is configured to detect a number of the resistance packs coupled thereto as well as data associated with exercise movements employing the resistance packs.

4 Claims, 14 Drawing Sheets

(51) Int. Cl.
*A63B 21/045* (2006.01)
*A63B 21/055* (2006.01)

(52) U.S. Cl.
CPC ..... *A63B 21/0557* (2013.01); *A63B 21/153* (2013.01); *A63B 21/4043* (2015.10); *A63B 21/04* (2013.01); *A63B 21/0552* (2013.01); *A63B 21/4029* (2015.10)

(58) Field of Classification Search
CPC ..... A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/15; A63B 21/152; A63B 21/151; A63B 21/153; A63B 21/154; A63B 21/157; A63B 21/159; A63B 21/22; A63B 21/227; A63B 21/4023; A63B 21/4027; A63B 21/4033; A63B 21/4035; A63B 21/4043; A63B 21/4045; A63B 21/4047; A63B 21/4049; A63B 23/03516; A63B 23/03533; A63B 23/03541; A63B 23/12; A63B 23/1209; A63B 23/1245; A63B 23/1254; A63B 23/1281; A63B 2220/10; A63B 2220/16; A63B 2220/80; A63B 2220/803; A63B 2220/83; A63B 2220/833; A63B 2225/09; A63B 2225/093
See application file for complete search history.

(56) References Cited

U.S. PATENT DOCUMENTS 885,074 A 4/1908 Nidever
913,799 A 3/1909 Zuend-Burguet
1,139,126 A 5/1915 Kerns
1,324,404 A 12/1919 Metzger
1,850,530 A 3/1932 Brown
1,867,642 A 7/1932 Woods
1,954,762 A 4/1934 Wolff
2,512,911 A 6/1950 Benice
RE23,744 E * 11/1953 Magida ..... A63B 21/0004 403/103
2,846,210 A 8/1958 Carrier
2,868,026 A 1/1959 Finehout
2,915,306 A * 12/1959 Hickman ..... F16F 1/3821 267/280
D194,042 S 11/1962 Guthormsen
3,441,271 A 4/1969 Palacios
3,544,105 A 12/1970 Latta
3,610,617 A 10/1971 Hepburn
3,690,654 A 9/1972 Hepburn
3,752,475 A 8/1973 Ott
3,764,132 A 10/1973 Hepburn
3,885,789 A 5/1975 Deluty
3,995,853 A 12/1976 Deluty
4,008,782 A 2/1977 Chanal
4,010,948 A 3/1977 Deluty
4,023,796 A 5/1977 Kusmer
4,077,626 A 3/1978 Newman
4,114,875 A 9/1978 Deluty
4,195,835 A 4/1980 Hinds
4,231,568 A 11/1980 Riley
4,235,439 A 11/1980 Donno
4,372,553 A 2/1983 Hatfield
4,374,588 A 2/1983 Ruggles
4,376,533 A 3/1983 Kolbel
4,478,413 A 10/1984 Siwula
4,511,137 A 4/1985 Jones
4,557,480 A 12/1985 Dudley
4,603,855 A 8/1986 Sebelle
4,611,807 A 9/1986 Castillo
4,625,961 A 12/1986 Brand
4,635,755 A 1/1987 Arechaga
4,645,204 A 2/1987 Berger
4,647,035 A 3/1987 Yellen
4,647,041 A 3/1987 Whiteley
4,709,918 A 12/1987 Grinblat
4,720,099 A 1/1988 Carlson
4,784,006 A 11/1988 Kethley
4,822,039 A 4/1989 Gonzales
4,824,104 A 4/1989 Bloch
4,826,145 A 5/1989 Moore
4,826,157 A 5/1989 Fitzpatrick
4,884,803 A 12/1989 Miller
4,944,511 A 7/1990 Francis
D317,959 S 7/1991 Francis
5,158,519 A * 10/1992 Hughes ..... A63B 21/015 482/115
5,209,461 A 5/1993 Whightsil, Sr.
5,226,867 A 7/1993 Beal
5,417,633 A 5/1995 Habing
5,433,683 A 7/1995 Stevens
5,507,712 A 4/1996 Chang
5,674,164 A 10/1997 Kravitz
5,690,596 A 11/1997 Parker
5,720,701 A 2/1998 Truini
5,743,830 A 4/1998 Ho
5,788,617 A 8/1998 Paris
5,788,618 A * 8/1998 Joutras ..... A43B 1/0054 482/114
5,954,621 A * 9/1999 Joutras ..... A43B 1/0054 482/114
5,980,435 A * 11/1999 Joutras ..... A43B 1/0054 482/114
6,030,321 A 2/2000 Fuentes
6,126,580 A 10/2000 Francis
6,224,514 B1 5/2001 Price
6,440,044 B1 8/2002 Francis
6,447,430 B1 9/2002 Webb
6,458,061 B2 10/2002 Simonson
6,561,959 B2 * 5/2003 Batiste ..... A63B 21/0004 482/118
6,605,022 B2 8/2003 Webber
6,685,602 B2 2/2004 Colosky
7,008,354 B2 3/2006 Wen
D521,087 S 5/2006 Francis
7,137,936 B1 * 11/2006 Shaw ..... A63B 21/025 482/127
7,229,391 B2 6/2007 Francis
7,306,549 B2 12/2007 Francis
7,740,568 B2 * 6/2010 Webb ..... A63B 21/0455 482/94
7,789,815 B2 9/2010 An
7,828,704 B1 11/2010 Hsieh
7,878,955 B1 2/2011 Ehrlich
7,942,793 B2 5/2011 Mills
7,955,237 B2 6/2011 Bisson
8,597,164 B2 12/2013 Francis et al.
9,488,239 B2 11/2016 Valembois
2002/0077227 A1 6/2002 Bastyr et al.
2002/0077230 A1 6/2002 Lull et al.
2006/0063650 A1 * 3/2006 Francis ..... A63B 21/0455 482/94
2006/0100069 A1 5/2006 Dibble et al.
2006/0116247 A1 6/2006 Dyer et al.
2006/0264303 A1 * 11/2006 Francis ..... A63B 21/0455 482/94
2008/0076647 A1 * 3/2008 Fine ..... A63B 21/00043 482/126
2008/0108918 A1 * 5/2008 Joutras ..... A61H 1/02 601/34
2013/0053741 A1 * 2/2013 Pittaccio ..... A61F 5/0102 602/16

(56) References Cited

U.S. PATENT DOCUMENTS

2013/0065740 A1* 3/2013 Francis ..... A63B 21/0004
482/122

FOREIGN PATENT DOCUMENTS

GB 155399 12/1920
WO 2006099484 1/2009

* cited by examiner

EXERCISE DEVICE AND PRELOADED RESISTANCE PACK

CROSS-REFERENCE TO RELATED APPLICATIONS

This application claims the benefit of U.S. Provisional Patent Application No. 62/353,909, filed Jun. 23, 2016 and U.S. Provisional Patent Application No. 62/406,697, filed Oct. 11, 2016 the disclosures of both of which are hereby incorporated herein in their entirety by reference.

BACKGROUND

Resistance exercise can provide many health and fitness benefits. Personal resistance exercise devices, including home gyms are plentiful in the consumer marketplace. However, there are many shortcomings that make personal resistance exercise devices inconvenient and cumbersome to use. Most personal exercise resistance devices employ either some form of weights or a resistance mechanism. Weights are inherently heavy, bulky, and are generally limited to use in a single location without some cumbersome transportation to another location.

Resistance mechanisms vary widely in type, complexity, and usability. Many incorporate extensible springs, flexible rods, extensible bands, or the like. These mechanisms may be lighter weight but are often complex and may still be bulky or not well adapted to movement between locations. Additionally, resistance mechanisms often resume a neutral state when placed in a normal or un-actuated position. Thus, when employed in an exercise movement, the amount of resistance provided thereby may start at zero, or be very low through an initial portion of a range of motion of the exercise, thus the user may be unable to get the full benefit of the resistance throughout the entire range of motion of the exercise. Or the user may be required to physically preload the resistance mechanism to achieve an initial resistance, which is cumbersome and may incur additional physical efforts and time. Devices that are configured to provide the desired resistance throughout the range of motion of the exercise may be difficult to manufacture and configure in a preloaded state.

SUMMARY

Embodiments of the technology are defined by the claims below, not this summary. A high-level overview of various aspects of exemplary embodiments is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a resistance pack that is useable with a variety of personal exercise equipment and that is preloaded so as to provide resistance throughout an entire range of motion and to aid coupling of the resistance pack with another resistance pack and/or with a personal exercise device. An exercise device configured for use with the resistance pack is also described.

The resistance pack includes an elastomeric resistance element with a known resistance force. The elastomeric resistance element may be configured with a plurality of spokes between a hub and an outer rim. The spokes are configured to wrap and stretch about the hub upon rotation of the hub relative to the rim. The elastomeric resistance element may be configured between a front plate and a back plate in a self-contained resistance pack. Multiple resistance packs may be coupled to each other to adjust the resistance provided.

The hub includes a pair of radially extending wings that lie against an interior surface of the back plate and that rotate with the hub. The back plate includes a pair of raised tabs on the interior surface that lie in the rotational path of the wings. The wings initially lie on a first side of the tabs and the resistance element is in a neutral state. The wings are rotated in a first direction toward the tabs causing the wings to slide over and past the tabs and at least partially stretching the spokes of the resistance element. The wings are then prevented from rotation in an opposite second direction by engagement with the tabs and the resistance element is maintained in a partially stretched or preloaded state.

The resistance packs may also include features that aid alignment with other resistance packs. The hub may include an internal axial bore extending at least partially therethrough and having a plurality of circumferentially spaced teeth, recesses, or similar engagement features. One or more of the teeth or recesses may be provided with a different form than others of the teeth or recesses such that a stub or rod configured for insertion into the bore is only insertable therein in a particular rotational alignment relative to the hub. The front and back plates may also be provided with a non-symmetrical arrangement of mating couplings such that the resistance pack may only be coupled to another resistance pack in a particular rotational orientation.

An exercise device configured for use with the resistance packs is also provided. The exercise device includes a pair of arms that are pivotable relative to one another about an axle that is coupled to the hub of the resistance packs such that the resistance packs provide resistance to such pivotal movements. The arms of the exercise device are pivoted toward one another when an adducting force or an abducting force is applied. Application of the abducting force employs tension members or cables and pulleys coupled to the arms to pivot the arms toward one another while handgrips on the exercise device are pulled away from one another. The configuration of the pulleys and tension members provides a greater range of motion of the hand grips in the abducting direction than in the adducting direction while the range of pivotal motion of the arms remains the same.

The exercise device may include an electronic controller and a number of sensors configured to detect and track the direction, rate, and/or the extent of the pivotal movements of the arms as well as a number of resistance packs coupled to the exercise device.

In one embodiment, an exercise device with a resistance pack is described. The exercise device includes a first arm having an axle disposed at a proximate end, a first receiver disposed at an opposite distal end, and a first pulley disposed along the length of the first arm between the proximate and distal ends, and a second arm having a proximate end that is pivotably coupled to the first arm to pivot about the axle, a second receiver disposed at a distal end of the second arm, and a second pulley disposed along the length of the second arm between the proximate and distal ends. A first handle that is removably disposed in the first receiver of the first arm and a second handle that is removably disposed in the second receiver of the second arm along with a first tension member that extends from the first handle, around the second pulley, and couples to the first arm, and a second tension member that extends from the second handle, around the first pulley, and couples to the second arm are also provided. The exercise device further includes a resistance pack that is non-rotatably coupled to the second arm and that engages the axle. The resistance pack resists pivotal movement of the distal end of the first arm toward the distal end of the second arm when an adducting force is applied to the first and second handles and when an abducting force is applied to the first and second handles. The exercise device further includes one or more of a sensor adapted to detect pivotal movements of the arms relative to one another, a sensor configured to detect rotation of one or both of the pulleys, and a sensor adapted to detect a characteristic that is useable to determine a number of resistance packs coupled to the exercise device.

In another embodiment, a method for sensing a number of resistance packs coupled to an exercise device is described. The method includes providing an exercise device including a pair of arms that are pivotable relative to one another, a strain gage disposed in one or both of the arms, and providing a plurality of resistance packs that are coupleable to the exercise device to provide resistance to pivoting the arms. The method further includes operably coupling at least one of the resistance packs to the exercise device. The arms are pivoted relative to one another and the strain gage detects a strain force or bending force encountered by the respective arm. The detected strain force is correlated with a resistance force and/or with a number of resistance packs required to provide the resistance force or the detected strain force.

DESCRIPTION OF THE DRAWINGS

Illustrative embodiments are described in detail below with reference to the attached drawing figures, and wherein.

DETAILED DESCRIPTION

The subject matter of select embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

With reference now to FIGS. 1-5, a resistance pack 10 is described in accordance with an exemplary embodiment. The resistance pack 10 can be employed with and configured for use with a variety of exercise equipment including personal, handheld apparatus and larger exercise stations, benches, or the like. Exemplary personal exercise devices are described in U.S. Pat. No. 8,579,164 to Francis et al. the disclosure of which is hereby incorporated herein by reference. The personal exercise devices described by Francis et al. generally include a pair of pivotably coupled arms with a resistance element, like the resistance pack 10, disposed at the pivotable coupling and configured to resist pivotal movement of one of the arms relative to the other arm.

Figure 5:
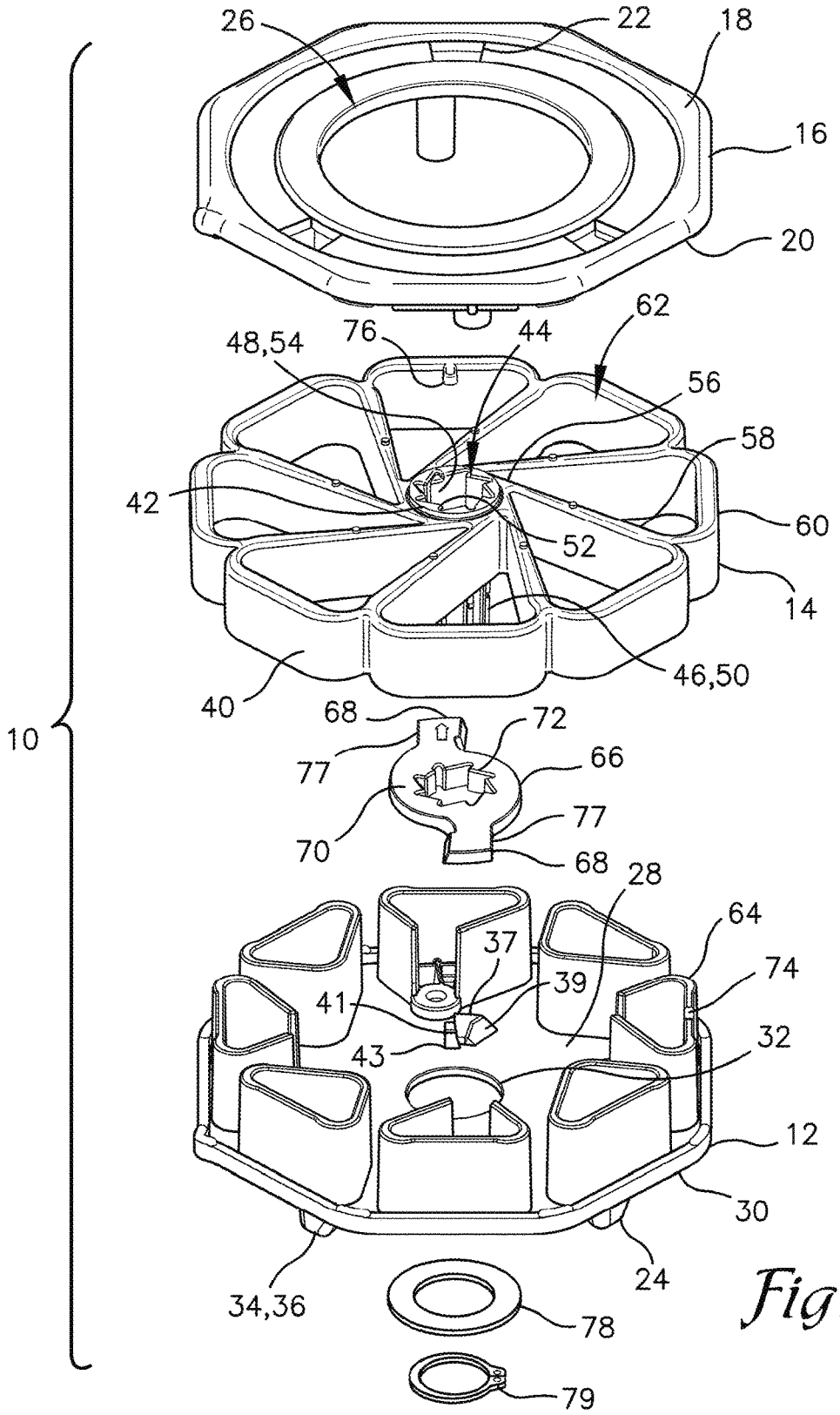
FIG. 5 is an exploded perspective view of the resistance pack of FIG. 1.

As best shown in FIG. 5, the resistance pack 10 includes a back plate 12, an elastomeric resistance element 14, and a front plate 16. The elastomeric resistance element 14 is sandwiched between the front plate 16 and the back plate 12 and the front plate 16 is permanently or temporarily coupled to the back plate 12. The front plate 16 of the resistance pack 10 includes a front face 18, an interior face 20, and a plurality of slots 22 configured to receive and engage a plurality of coupling fingers or arms 24 of the back plate 12 of another resistance pack 10. The front plate 16 may also include an aperture 26 for viewing the elastomeric resistance element 14 therethrough.

Figure 1:
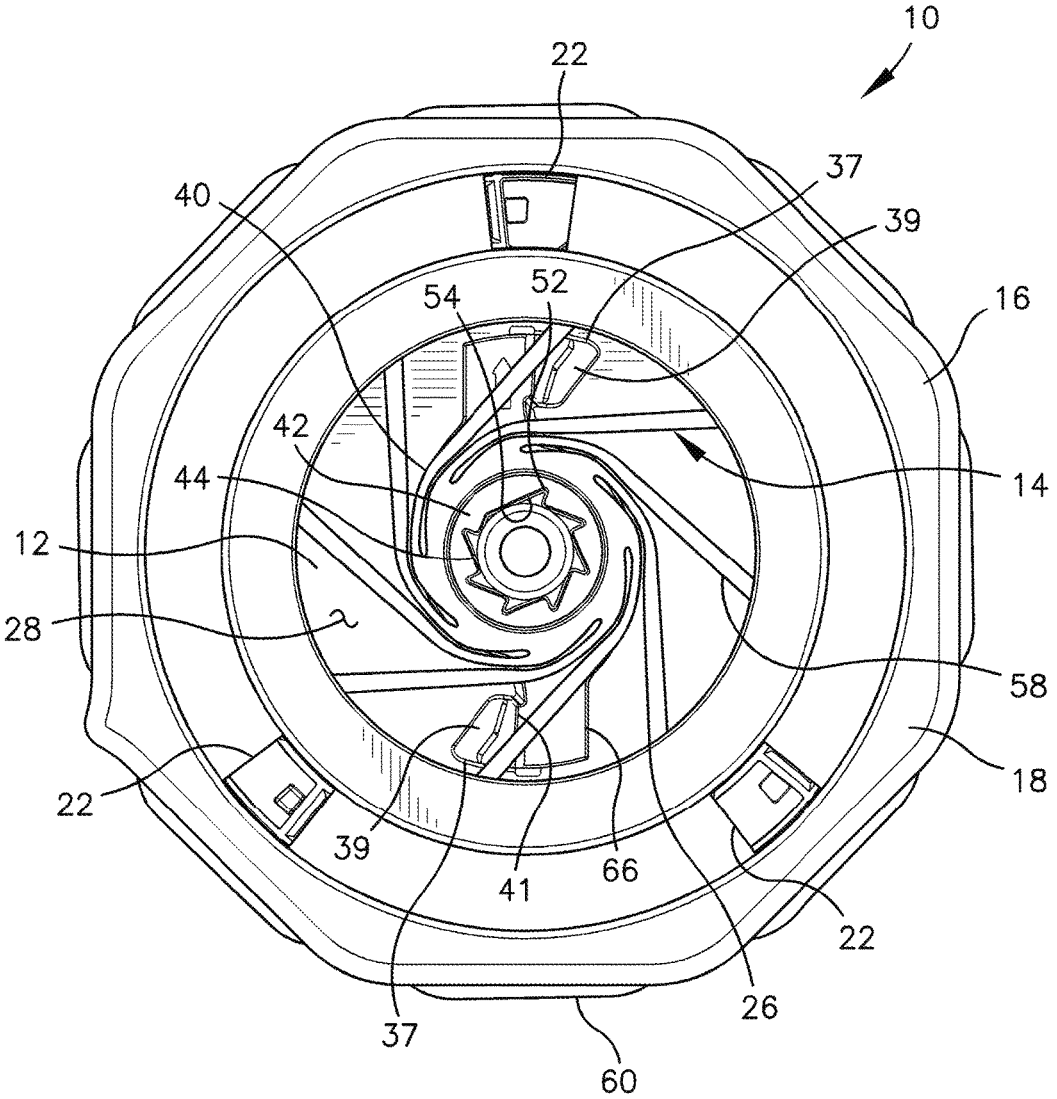
FIG. 1 is front plan view of a resistance pack depicted in accordance with an exemplary embodiment.
Figure 2:
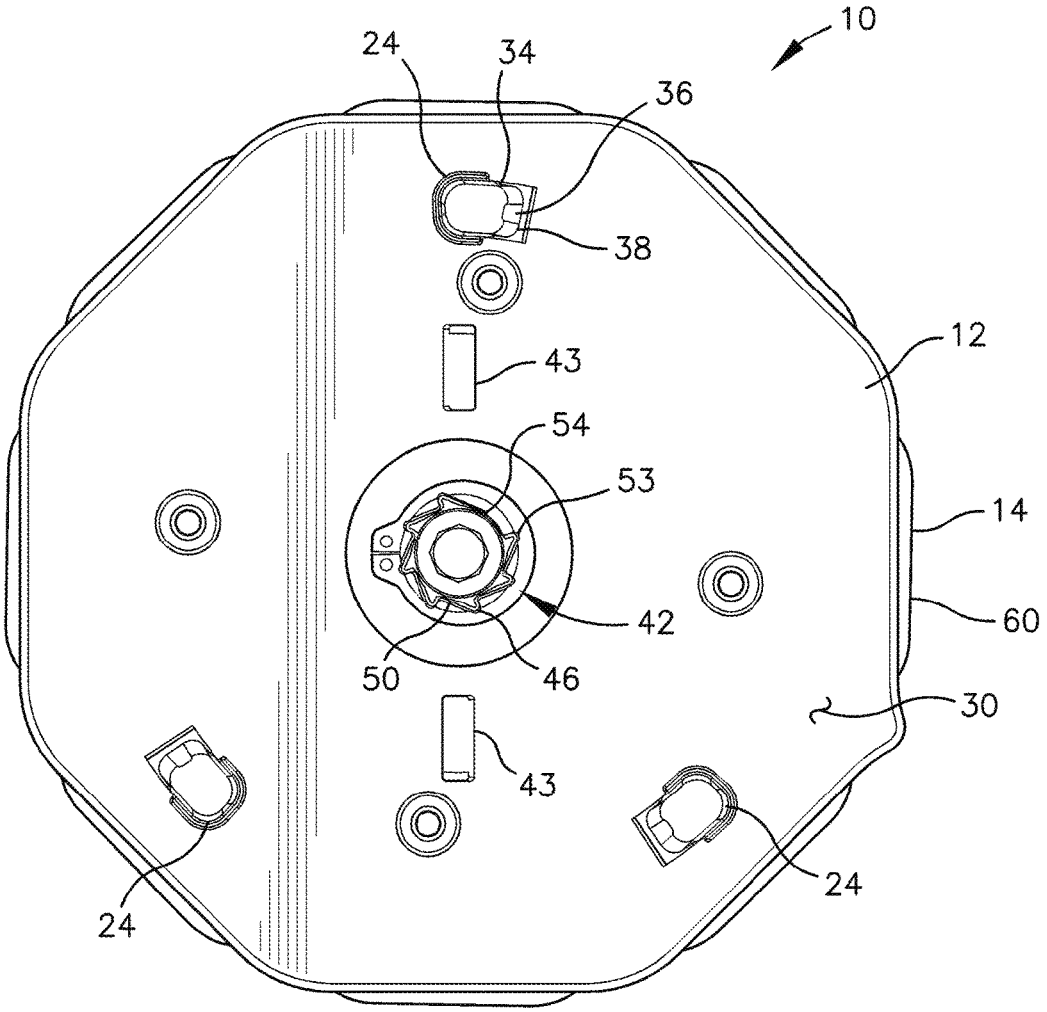
FIG. 2 is back plan view of the resistance pack of FIG. 1.
Figure 4:
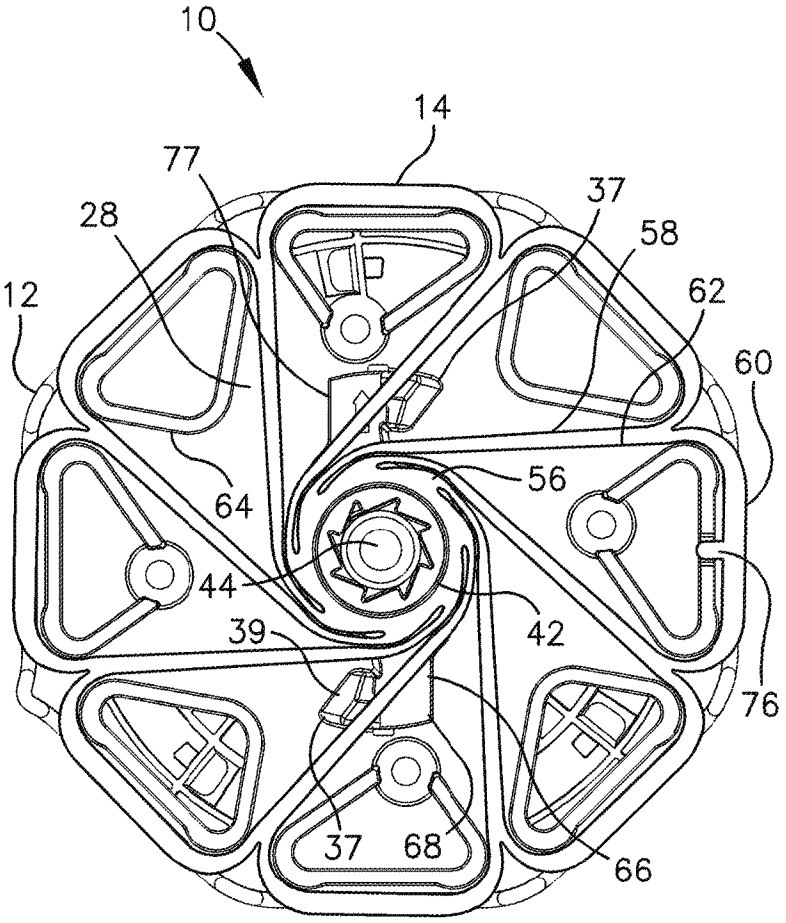
FIG. 4 is a front plan view of the resistance pack of FIG. 3 with the resistance element in a preloaded state.
Figure 3:
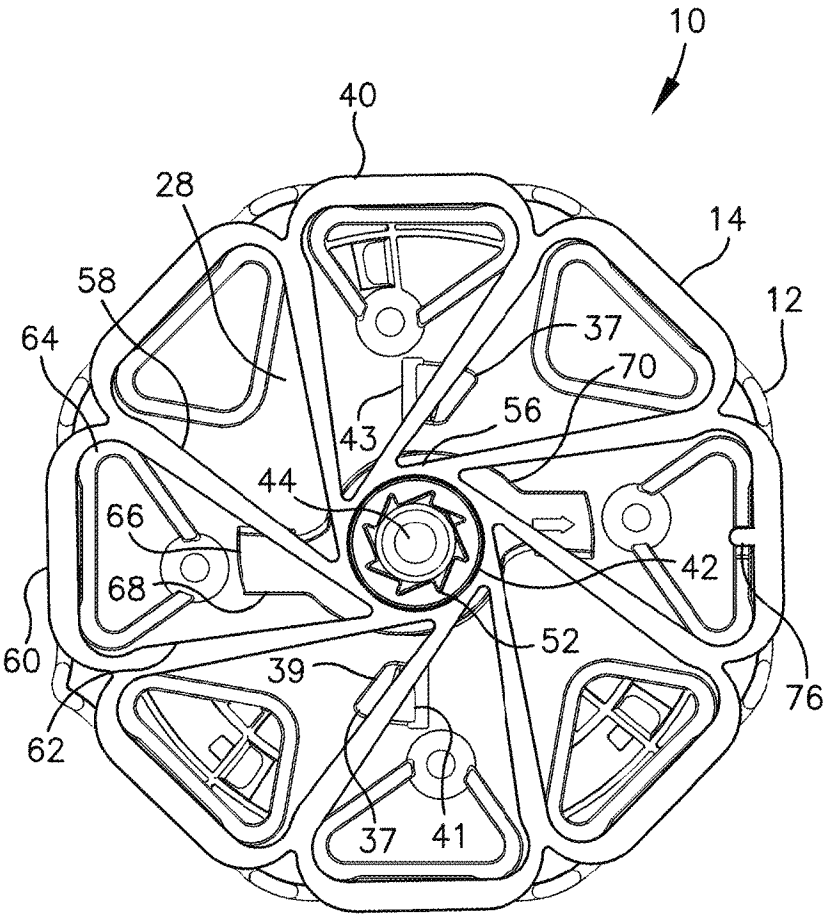
FIG. 3 is a front plan view of the resistance pack of FIG. 1 with a front plate removed and with a resistance element in a neutral state.

The back plate 12 includes an interior face 28, a back face 30, a central aperture 32, and the plurality of coupling arms 24 coupled to and extending away from back face 30. The coupling arms 24 are distributed about the back face 30 at generally equal radial distances from the central aperture 32, but at irregularly spaced intervals or distances along a circular path defined by the radial distance. Each of the coupling arms 24 may include a hook 34 or similar engagement feature formed at a distal end thereof. The hook 34 extends generally orthogonally to a body of the coupling arm 24 and includes a tapered top edge 36 and a tapered bottom edge (depicted in FIG. 6 by reference numeral 190) that come together to form a point 38. Each of the points 38 are directed in the same circumferential direction, e.g. in a clockwise direction as depicted in FIG. 2.

A pair of tabs 37 is provided on the interior face 28 of the back plate 12. The tabs 37 are disposed at generally equal radial distances from the aperture 32 and on diametrically opposite sides of the aperture 32. The tabs 37 may include a sloped face 39 and a stop face 41 and may include a through-hole 43 disposed adjacent the stop face 41. Picturing the tabs 37 as being positioned along a circular path and traveling along the circular path in a first direction, e.g. counterclockwise as depicted in FIG. 5, the sloped faces 39 are positioned to be contacted first, while the stop faces 41 are positioned to be contacted first when traveling in an opposite second direction, e.g. clockwise, as described in greater detail below.

The elastomeric resistance element 14 comprises an elastomeric member 40 coupled to a hub 42. The hub 42 comprises a substantially rigid cylindrical structure with a blind axial bore 44 extending at least partially therethrough and an stub axle 46 extending axially away from the closed end of the bore 44. The bore 44 forms a female portion into which the stub axle 46 of another resistance pack 10 can be inserted to join two or more resistance packs 10 in rotational motion of their respective hubs 42, as described more fully below. An interior surface 48 of the bore 44 and an exterior surface 50 of the stub axle 46 each include a plurality of complimentary teeth 52, 53 respectively or similar engagement features, such as recesses, ridges, or facets configured to interlock and resist relative rotational motion between the hubs 42 of mated resistance packs 10. As depicted in FIGS. 1-5, the bore 44 and stub axle 46 are provided with matching but non-uniform teeth 52, 53, e.g. a flat 54 is provided on both the bore 44 and stub axle 46, such that the bore 44 and stub axle 46 can only be mated in a particular rotational alignment.

The elastomeric member 40 is fixedly coupled about the circumference of the hub 42 and along a portion thereof that generally corresponds with the bore 44; the stub axle 46 extends beyond the plane of the elastomeric member 40. The elastomeric member 40 may be molded to the hub 42 or coupled thereto via one or more adhesives, welding, fasteners, mechanical engagements, or the like. The elastomeric member 40 includes a central body 56 that encircles the hub 42 and from which a plurality of spokes 58 extend generally tangentially therefrom.

Distal ends of the spokes 58 turn to generally follow a circumferential path or rim 60 and join with an adjacent spoke 58 to form a generally triangular loop 62. A plurality of generally triangular projections 64 are provided on the interior face 28 of the back plate 12 and are configured to engage the loops 62. Engagement of the projections 64 by the loops 62 anchors the rim 60 of the elastomeric member 40 against rotational movement relative to the back plate 12.

The elastomeric member 40 may be constructed from any elastomeric polymer material now known or hereafter developed. In one embodiment, a blend of natural rubber and polybutadiene is employed. For example, a well-performing blend with an acceptable fatigue life might include about 80% natural rubber and about 20% polybutadiene. The amount of resistance provided by spokes 58 is a combination of the number of spokes, the length, the material's modulus of elasticity and the cross-sectional area of the spoke 58. The cross-sectional area of spokes 58 may be substantially constant, whereas other embodiments may include a varying cross-sectional area to provide a variable resistance. Depending on the material properties of the spokes, the resistance may increase the further the material is elastically stretched. The cross-sectional area of the spokes 58, their configuration, and/or the configuration of the exercise device with which the resistance pack 10 is to be used may be configured to flatten a torque curve produced by the elastomeric resistance element 14. The spokes 58 may be configured to provide a certain equivalent resistance in "pounds" or "kilograms." For example, the resistance element 14 may be configured with a two-pound resistance, five-pound resistance, ten-pound resistance, or any other value or interval in pounds or kilograms. Or the resistance element 14 might be configured to provide varying levels of resistance throughout an operating range.

With continued reference to FIG. 5, a wing plate 66 is disposed between the elastomeric resistance element 14 and the back plate 12. The wing plate 66 includes a pair of wings 68 extending from a body 70 in substantially diametrically opposing directions. An aperture 72 is provided in the body 70. The aperture 72 includes a perimeter configured to receive the stub axle 46 therethrough and to engage the teeth 53 thereon so as to fix the relative rotational orientation between the wing plate 66 with the hub 42. The wings 68 extend a radial distance that is equal to or greater than that of the tabs 37 on the back plate 12. As such, the tabs 37 are positioned to interfere with the rotational motion of the wing plate 66, as described more fully below.

Referring again to FIGS. 1-5, assembly of the resistance pack 10 is described in accordance with an exemplary embodiment. The wing plate 66 is installed on the stub axle 46 by inserting the stub axle 46 through the aperture 72. The aperture 72 and/or the stub axle 46 may be configured to require a particular rotational orientation therebetween. In another embodiment, the hub 42 is formed with an integral wing plate 66 and/or wings 68.

The resistance element 14 is next installed on the back plate 12. The projections 64 on the interior face 28 of the back plate 12 are inserted into the loops 62 formed by the spokes 58 and the rim 60 of the elastomeric member 40. One or more of the spokes 58 and/or the rim 60 and one or more of the projections 64 may be provided with an alignment feature, such as a notch 74 and a tab 76 to aid an assembler in identifying proper orientation of the resistance element 14 with the back plate 12 and/or to prevent misalignment thereof.

Insertion of the projections 64 into the loops 62 also requires insertion of the stub axle 46 through the central aperture 32 in the back plate 12 and disposing the wing plate 66 against the interior face 28 of the back plate 12. The hub 42 or a base of the stub axle 46 may include surface features configured to receive a washer 78 and a lock ring 79 thereon to prevent withdrawal of the stub axle 46 from the central aperture 32. The front plate 16 is disposed to capture the resistance element 14 between the front plate 16 and the back plate 12. The front plate 16 is fastened or coupled to the back plate 12 using one or more fasteners, adhesives, mechanical engagements, welding, or the like.

Initially, the elastomeric member 40 is in a neutral state in which no tension is applied to the spokes 58 and a leading edge 77 of the wings 68 of the wing plate 66 are positioned nearest to the sloped face 39 of the tabs 37 on the back plate 12. The stub axle 46 and/or the blind bore 44 of the hub 42 is engaged and rotated in the first direction, e.g. counterclockwise as depicted in FIG. 5, to move the wings 68 into contact with the sloped faces 39 of the tabs 37. Continued rotation of the hub 42 moves the wings 68 up the sloped faces 39, over the top of and past the tabs 37. The wings 68 may flex or bend axially and/or the back plate 12 or the tabs 37 may partially bend or flex to allow passage of the wings 68. Upon passing the tabs 37, an audible click or similar sound is produced and may indicate to a manufacturer that sufficient rotation has been completed.

In another embodiment, the tabs 37 do not include the sloped faces 39. In order to move the wings 68 past the tabs 37 in the first direction, an axial force is applied to move the wings 68 and/or the hub 42 away from the interior face 28 of the back plate 12 a distance sufficient to allow the wings 68 to pass over the tabs 37 as the hub 42 is rotated in the first direction. The axial force can then be relieved to allow the hub 42 and the wings 68 to move back toward the back plate 12. Alternatively, the hub 42 and the wings 68 can be rotated in the first direction relative to the distal ends of the spokes 58 before the resistance element 14 is installed on the back plate 12; the wings 68 would thus be moved past the tabs 37 prior to installation on the back plate 12. In such an embodiment, the projections 64 might be provided on the interior face 20 of the front plate 16 to aid rotation of the hub 42 relative to the distal ends of the spokes 58 prior to engagement with the back plate 12.

Figure 8:
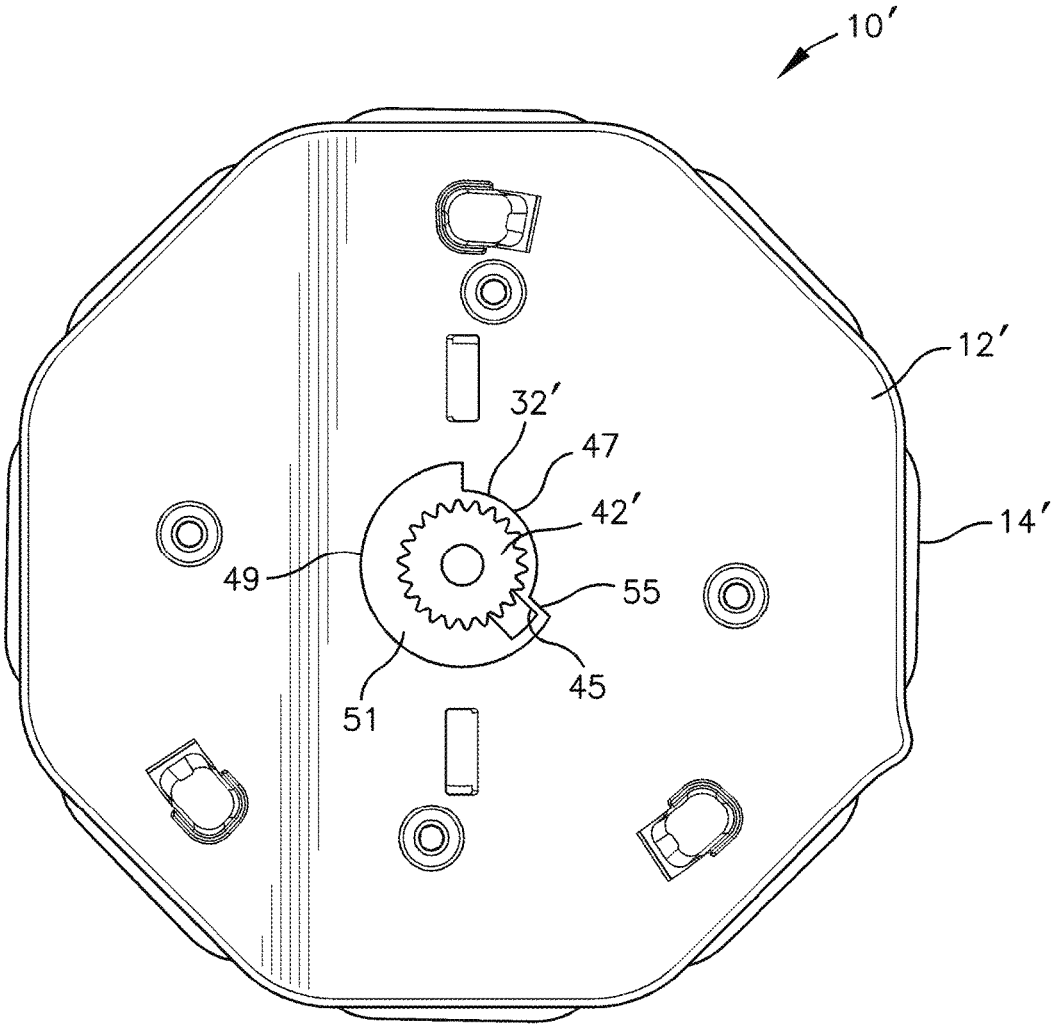
FIG. 8 is a back plan view of a resistance pack depicted in accordance with another exemplary embodiment.

In another embodiment depicted in FIG. 8, the wing plate 66 and the tabs 37 are replaced by providing the central aperture 32' in the back plate 12' with an irregular perimeter configured to engage an integrated wing 45, tooth, spline, or similar structure provided on the hub 42'. For example, the perimeter of the central aperture 32' can be provided with first portion 47 having a first radial dimension and a second portion 49 having a larger second radial dimension thus forming an annular notch 51 in the perimeter of the central aperture 32'. During assembly, the hub 42' is rotated relative to the distal ends of the spokes 58' (not shown but configured similarly to the spokes 58) prior to installing the resistance element 14' on the back plate 12' in a manner similar to that described immediately above. The integrated wing 45 is aligned with the annular notch 51 and disposed therein as the resistance element 14' is installed on the back plate 12'. A terminal edge 55 of the annular notch 51 engages the integrated wing 45 to retain the hub 42' against rotational motion in the opposite second direction.

Alternatively, the resistance element 14' can be installed on the back plate 12' with the integrated wing 45 not aligned with the annular notch 51. The misalignment and the elasticity of the spokes 58' allows the hub 42' to be axially deflected relative to the distal ends of the spokes 58' as the spokes 58' are engaged with the back plate 12'. The hub 42' is then rotated in the first direction to bring the integrated wing 45 into alignment with the annular notch 51 at which point the integrated wing 45 and the hub 42' move axially toward the back plate 12' to engage the wing 45 in the annular notch 51. The elasticity of the spokes 58' provides an axial bias on the hub 42' which operates to move the hub 42' toward the back plate 12'.

Returning to FIGS. 1-5, rotation of the hub 42 also at least partially stretches the spokes 58 of the resistance element 14 and places the resistance element 14 in a preloaded state in which the spokes 58 are maintained in tension, e.g. the spokes 58 are maintained in a state in which a force is continuously applied towards rotation of the hub 42 in the opposite second direction. Rotation of the hub 42 in the opposite second direction is resisted by engagement of the wings 68 with the stop faces 41 of the tabs 37. The wings 68 contact the stop faces 41 of the tabs 37 and are substantially prevented from sliding or moving over or past the tabs 37 in the opposite second direction. The stop faces 41 may be angled, sloped, or undercut to further resist upward travel of the wings 68 over the tabs 37. Trailing edges of the wings 68 may also be configured to compliment the slope or undercut of the stop faces 41 and/or the sloped faces 39. The through-holes 43 may be provided adjacent the stop faces 41 to allow insertion of a tool to force the wings 68 over the tabs 37 and allow the resistance element to again assume the neutral state such as during disassembly of the resistance pack 10.

In the preloaded state, the resistance pack 10 is configured to provide at least a predetermined resistance to rotation of the hub 42 relative to the back plate 12. In the neutral, non-preloaded state, little to no resistance is provided against at least partial rotation of the hub 42. As such, when employed for performing an exercise, the preloaded resistance pack 10 provides at least the predetermined resistance throughout the entire range of motion of the exercise. If the resistance pack 10 was initially in the neutral state, an initial portion of the range of motion of the exercise would be provided with little to no resistance; such a non-preloaded configuration is highly undesirable.

Figure 9:
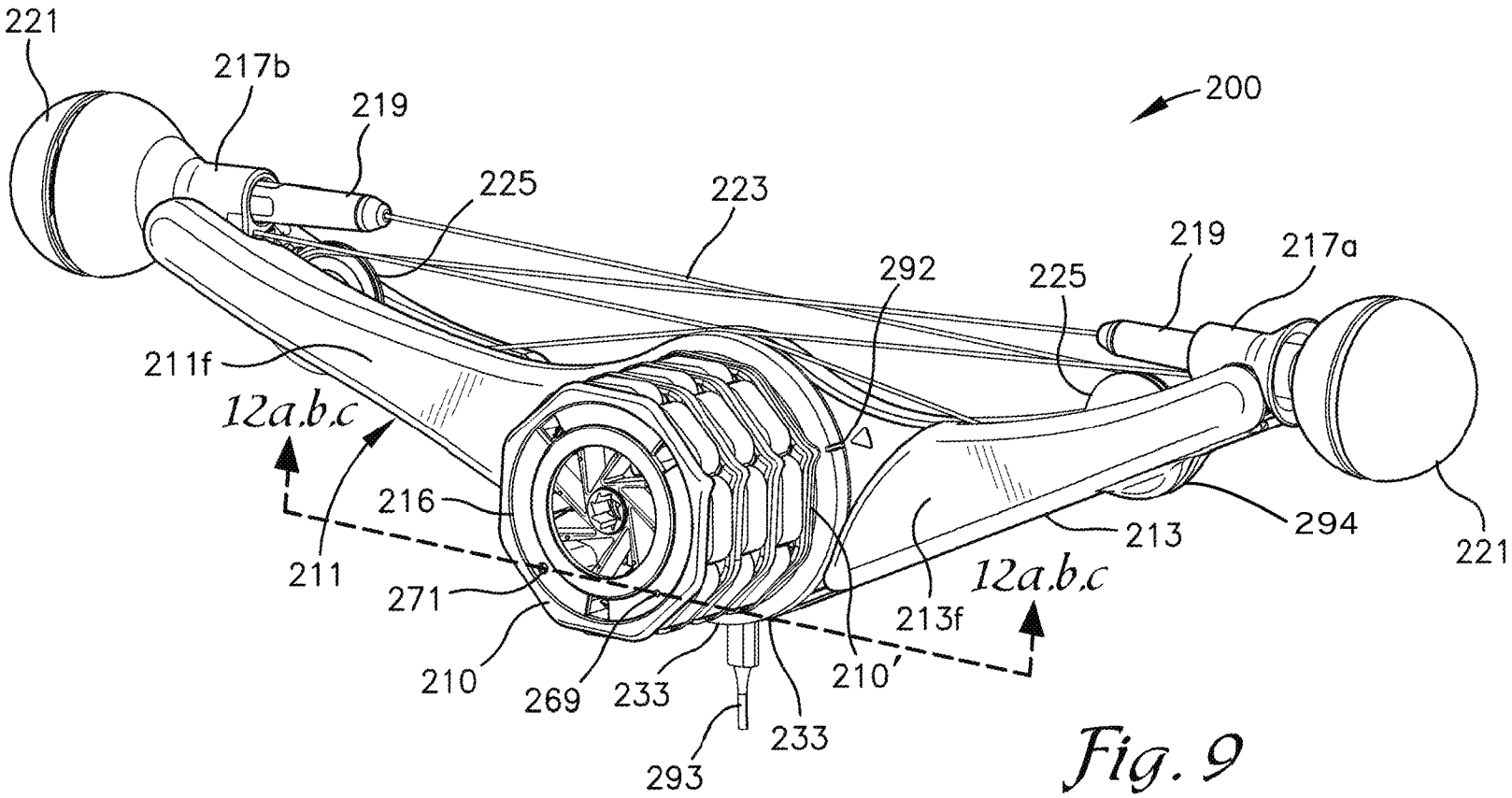
FIG. 9 is a perspective view of an exercise device depicted in accordance with an exemplary embodiment.

During use, the resistance pack 10 is coupled to an exercise device or personal exercise equipment such that actuation or operation of the exercise device causes rotation of the hub 42 relative to the back plate 12. Thereby the spokes 58 of the elastomeric member 40 are stretched and provide resistance to the operation of the exercise device; the resistance being desired by a user when performing an exercise using the exercise device. For example, the resistance pack 10 may be coupled to a personal exercise device having a pair of arms that pivot relative to one another, like that described in the '164 patent to Francis et al. and the exercise device 200 described below and depicted in FIGS. 9-11. The resistance pack 10 can be disposed at or near the pivot point between the arms with the back plate 12 being coupled to one of the arms and the hub 42 being coupled to the other of the arms. As such, pivoting of the arms relative to one another also rotates the hub 42 relative to the back plate 12.

The resistance pack 10 can be removably coupled to the exercise device and/or to another resistance pack 10 via the coupling arms 24 extending from the back plate 12. Alternatively, the resistance pack 10 can be integrated with or fixedly coupled to an exercise device. For example, the back plate 12 can be formed integral with the exercise device or can be affixed thereto via one or more fasteners, adhesives, welding, or the like.

To couple the resistance pack 10 to another resistance pack 10 or to an exercise device configured for coupling thereto, the coupling arms 24 are aligned with the slots 22 in the front plate 16 of the second resistance pack 10 or with similar slots provided in a wall of the exercise device. The arms 24 and slots 22 are distributed to ensure proper orientation of the resistance pack 10 relative to the second resistance pack 10 or to the exercise device. Proper alignment of the coupling arms 24 and the slots 22 also provides proper alignment of the teeth 53 on the stub axle 46 with teeth 52 in the bore 44 of the second resistance pack 10 or in a bore provided on the exercise device.

The resistance pack 10 is moved toward the second resistance pack 10 in a first axial direction to partially engage the stub axle 46 with the bore 44. The coupling arms 24 begin engagement with the slots 22 after the stub axle 46 and the bore 44 are at least partially engaged. The top edges 36 of the hooks 34 on the coupling arms 24 contact edges of the slots 22. Further axial movement of the resistance pack 10 in the first axial direction causes the resistance pack 10 to be slightly rotated in a first direction to allow the top edges 36 of the hooks 34 to slide along the edges of the slots 22 and to allow the coupling arms 24 to move further into the slots 22. Upon passing the point 38 of the hook 34 the resistance pack 10 rotates slightly in an opposite second direction to return to its original rotational orientation and to engage the hook 34 with the slot 22, e.g. the point 38 of the hook 34 overlaps with the back plate 12 adjacent the slot 22.

The hub 42, however does not rotate with the remainder of the resistance pack 10 because of the engagement of the stub axle 46 with the bore 44. As such, the resistance element 14 provides resistance to the slight rotation in the first direction and biases the resistance pack 10 toward the slight rotation in the second direction. The bias also aids to maintain the engagement of the hooks 34 with the slots 22.

Removal or decoupling of the resistance pack 10 from the second resistance pack 10 and/or the exercise device operates in reverse of the above description with the sloped bottom edge (depicted as element 190 in FIG. 6) of the hook 34 functioning in a manner similar to the top edge 36 to cause partial rotation of the resistance pack 10 as the resistance pack 10 is moved axially away from the second resistance pack 10 or exercise device. The hooks 34 are thus disengaged from the slots 22 and the resistance pack 10 is freed from the engagement. Accordingly, coupling and decoupling of the resistance pack 10 with another resistance pack 10 or exercise device can be completed by a user applying only an axial force. The structure of the resistance pack 10 will operate to provide the slight rotations for engagement. Or the user may apply a slight rotational force along with an axial force to further ease coupling/decoupling. In another embodiment, the bottom edge of the hook is not sloped, rather the user is required to apply the slight rotation of the resistance pack 10 before applying the axial force in order to decouple the resistance pack 10.

Figure 6:
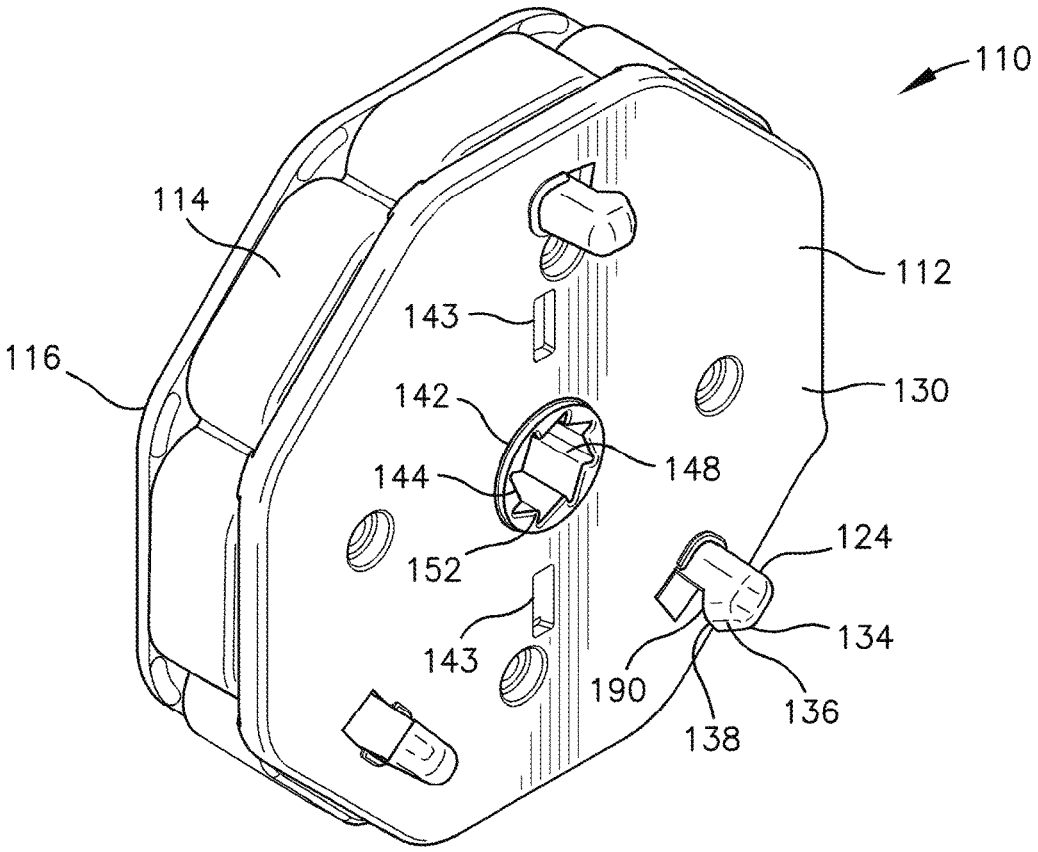
FIG. 6 a back perspective view of a resistance pack configured for use with an exercise equipment device having a rod that is inserted through the resistance pack depicted in accordance with an exemplary embodiment.
Figure 7:
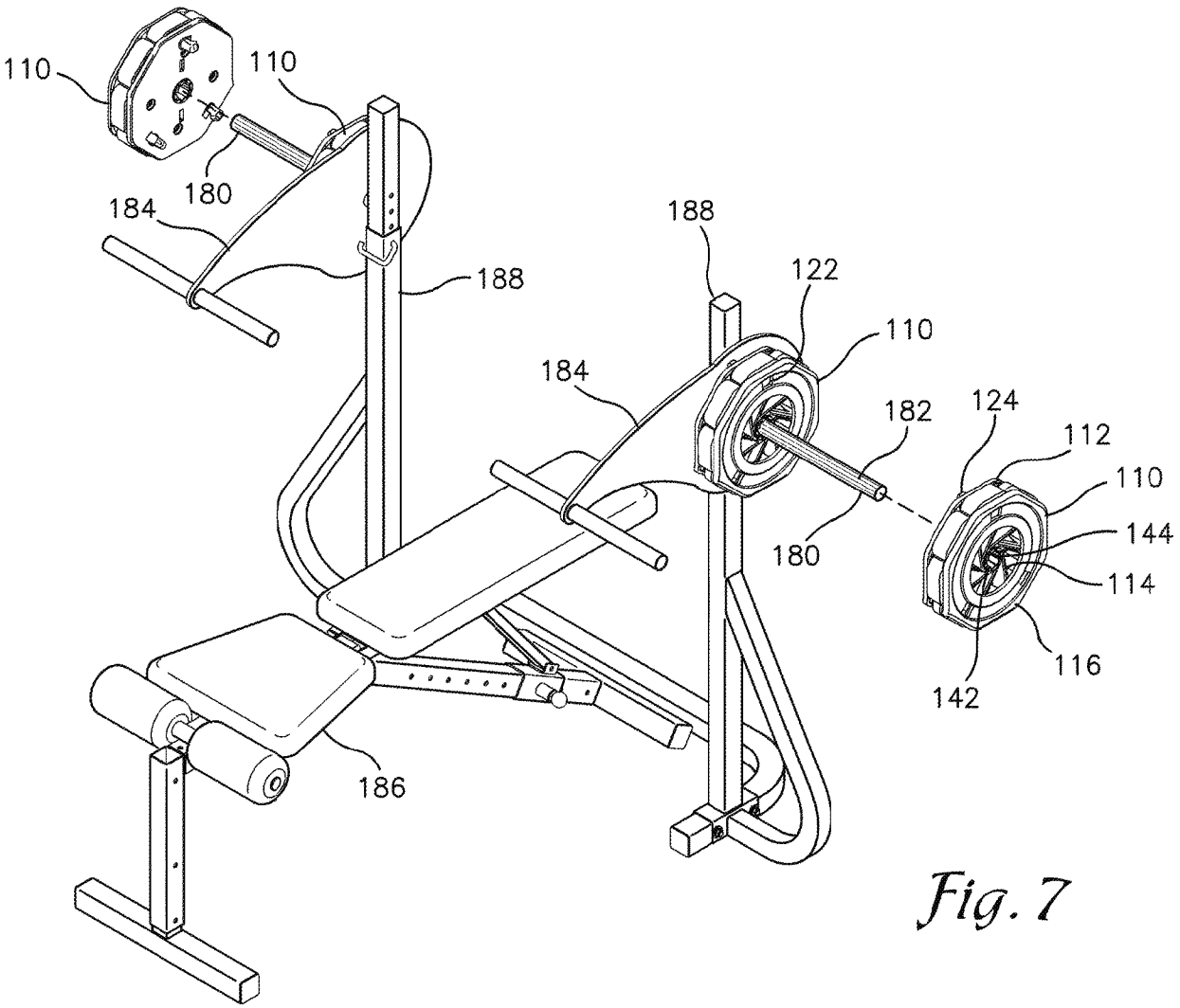
FIG. 7 is a perspective view of a home-gym bench configured for use with a plurality of the resistance packs of FIG. 6 depicted in accordance with an exemplary embodiment.

With reference now to FIGS. 6 and 7, a resistance pack 110 is described in accordance with another exemplary embodiment. The resistance pack 110 is substantially the same as the resistance pack 10 but includes a hub 142 having a somewhat different configuration that enables the resistance pack 110 to be disposed on a splined rod 180.

The hub 142 does not include a stub axle like that of the hub 42, but rather includes a bore 144 that extends through the axial thickness of the hub 142 and that is open at each end thereof. The bore 144 includes teeth 152, facets, or similar engagement features or structures configured like the teeth 52 described above.

The splined rod 180 comprises an elongate rod having splines 182, teeth, facets, or ridges configured to compliment the teeth 152. As such the rod 180 can be inserted through the bore 144 with the teeth 152 and splines 182 in engagement to prevent relative rotational motion between the hub 142 and the rod 180. As depicted in FIG. 7, a back plate 112 (similar to the back plate 12) of the resistance pack 110 couples to a pivotable lever arm 184 of an exercise station 186 and the splined rod 180 is fixedly coupled to a support bar 188 of the exercise station 186. Multiple resistance packs 110 can be disposed on the splined rod 180 and coupled together in a manner similar to that described above for the resistance pack 10.

In use, a user pivots the lever arm 184 to perform an exercise, such as a bench press. Pivoting of the lever arm 184 rotates the resistance pack 110 about the splined rod 180 which does not rotate. In another embodiment, the splined rod 180 is rotated by the use's operation of the exercise station 186 and the structure to which the back plate 112 is coupled is held static. Spokes 158 of a resistance element 114 of the resistance pack 110 are thus stretched to provide a desired resistance for the exercise. The user can adjust a level of resistance for the exercise by installing more or fewer resistance packs 110 on the splined rod 180 and/or by selecting resistance packs 110 configured to provide one of a variety of resistance levels. For example, the user might install four resistance packs 110 that are configured to provide ten pounds of resistance each, or the user might install a single resistance pack 110 configured to provide forty pounds of resistance. Although a weight bench-style exercise station 186 is depicted in FIG. 7, it is understood that the resistance packs 10 and 110 can be employed in a variety of exercise stations and devices without departing from the scope of embodiments described herein.

With reference now to FIGS. 9-12, an exercise device 200 that is useable with resistance packs 210, which are configured similarly to the resistance packs 10, is described in accordance with an exemplary embodiment. But for the improvements described herein, the exercise device 200 is constructed and operates in generally the same manner as the personal exercise device described in the '164 patent to Francis et al. The description of the personal exercise device provided in the '164 patent is incorporated herein by reference to act as a basis upon which improvements thereto and included in the exercise device 200 can be described. As such, only a cursory description of the major construction of the exercise device 200 is provided herein.

The exercise device 200 includes a pair of arms 211, 213 that are pivotably coupled by an axle 215 disposed through proximate ends thereof. The proximate ends of the arms 211, 213 overlap such that the proximate end of the arm 211 provides a coupling location for coupling with the resistance pack 210 while the proximate end of the arm 213 non-rotatably couples to the axle 215. Pivoting of the arms 211, 213 relative to one another thus rotates the axle 215 relative to the arm 211 and relative to the resistance pack 210 coupled thereto. The axle 215 engages a hub 242 of the resistance pack 210 which in turn provides resistance to rotation of the axle 215 and/or pivoting of the arms 211, 213 relative to one another.

The arms 211, 213 extend substantially equal distance from the axle 215 at an obtuse angle to one another and each includes a receiver 217*a* and 217*b* respectively that is pivotably coupled to its distal end. Each receiver 217*a*, 217*b* comprises a generally cylindrical collar configured to generally coaxially receive a post 219 of a hand grip 221. The post 219 is slideably insertable and removable from the receiver 217*a* or 217*b* and includes a tension member 223 coupled to a terminal end thereof and extending through the receiver 217*a* or 217*b* to the opposite arm 211 or 213. The hand grips 221 can be grasped by a user and moved toward one another to pivot the arms 211, 213 toward one another in an adducting motion (depicted by arrows ADD in FIG. 11*b*), or the hand grips 221 can be pulled away from one another and out of the receivers 217*a* and 217*b* in an abducting motion (depicted by arrows ABD in FIG. 11*a*) which again pivots the arms 211, 213 toward one another via the tension members 223; the resistance pack 210 provides resistance to both the adducting and abducting motions.

The arms 211, 213 each include a pulley 225 disposed along their length between the proximate and distal ends. The tension member 223 extending from the terminal end of the post 219 of the hand grip 221 on the arm 211 wraps around the pulley 225 on the opposite arm 213 and returns to the receiver 217*a* on arm 211 where it is fixedly coupled.

The tension member 223 extending from the post 219 of the hand grip 221 on the arm 213 wraps around the pulley 225 on the arm 211 and returns to the receiver 217*b* arm 213. The tension members 223 can be coupled to the respective receivers 217*a* and 217*b*, to support structures associated with the receivers 217*a* and 217*b*, or to the respective arms 211, 213.

The pulleys 225 may be at least partially disposed with a pulley housing 294 formed by or on the arms 211, 213. The pulley housing 284 substantially encloses the pulleys 225 and resists entrapment of objects in the pulleys 225 and/or contact of objects with the pulleys 225.

Incorporation of the pulleys 225 enables greater range of motion of the handgrips 221 away from one another when the abducting force ABD is applied than is available when the tension members 223 connect directly to the opposite arm 211, 213 or indirectly to the arms 211, 213 through the receivers 217*a*, 217*b* or other structure disposed on the opposite arm 211, 213. The range of motion may be about twice that available without use of the pulleys 225. Use of the pulleys 225 also decreases the amount of resistance to the movement of the handgrips 221 in the abducting direction ABD that is provided by the resistance pack 210. It is understood that the actual resistance provide by the resistance pack 210 to movement of the arms 211, 213 in the adducting direction ADD remains the same but the resistance encountered by the handgrips 221 is reduced. The resistance to movement of the handgrips in the abducting direction ABD is generally about half of the resistance encountered in the adducting direction ADD. Accordingly in one embodiment, the exercise device 200 provides a range of motion, X, and a resistance, Y, in the adducting direction ADD, and a range of motion, 2X, and a resistance, 0.5Y, in the abducting direction.

Figure 10A:
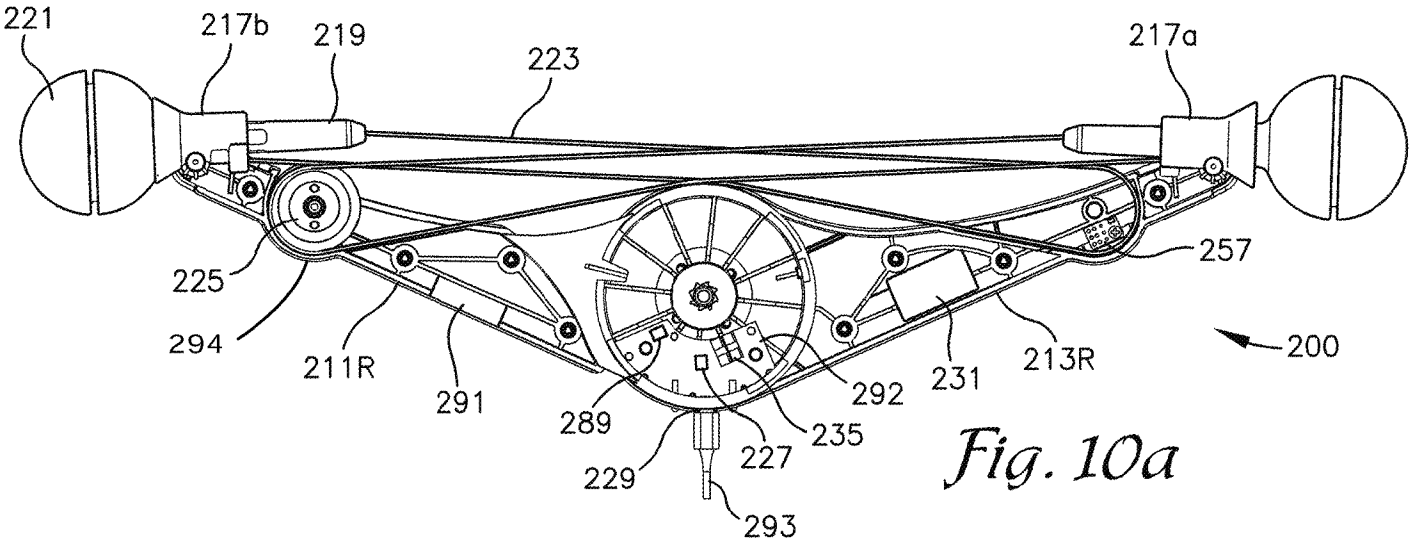
FIG. 10*a* is a front elevational view of the exercise device of FIG. 9 with front portions of arms of the exercise device removed to reveal internal structures.
Figure 10B:
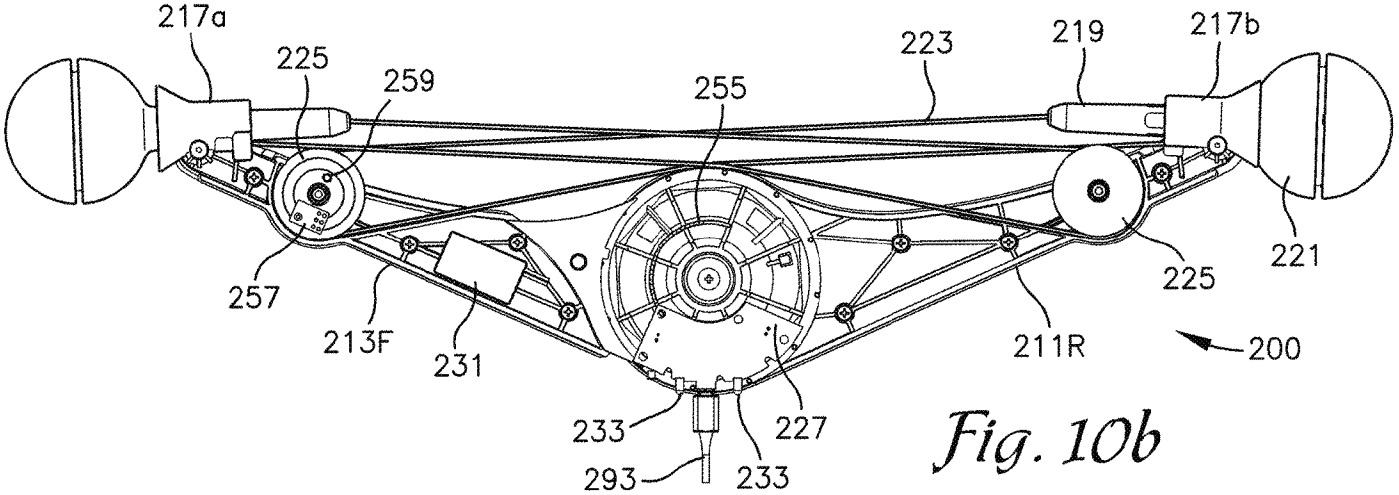
FIG. 10*b* is a rear elevational view of the exercise device of FIG. 9 with rear portions of the arms removed to reveal internal structures.
Figure 11A:
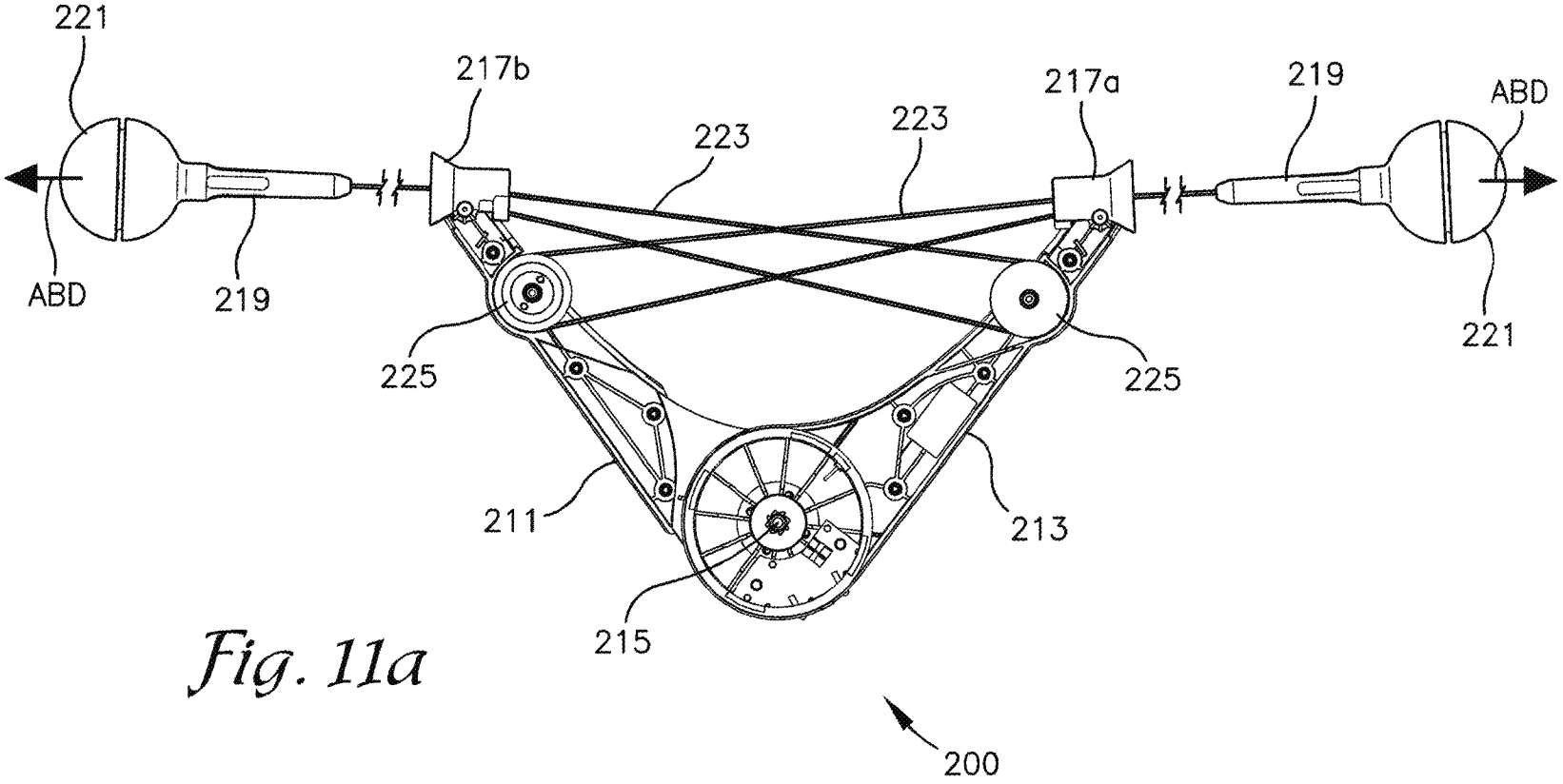
FIG. 11*a* is a front elevational view of the exercise device of FIG. 9 with the front portions of the arms removed and with the arms partially pivoted toward one another as a result of an abduction force applied on the exercise device depicted in accordance with an exemplary embodiment.
Figure 11B:
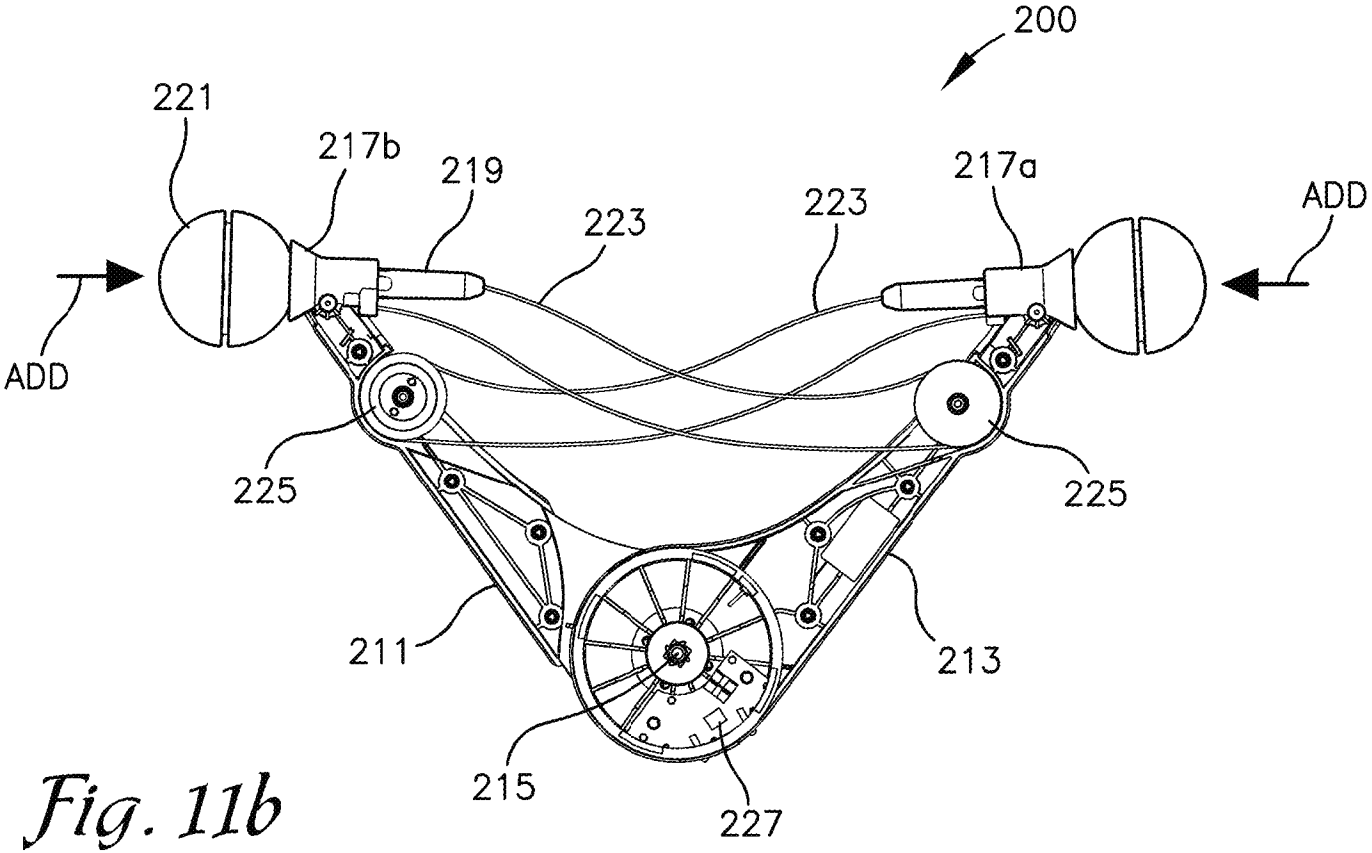
FIG. 11*b* is a front elevational view of the exercise device of FIG. 9 with the front portions of the arms removed and with the arms partially pivoted toward one another as a result of an adduction force applied on the exercise device depicted in accordance with an exemplary embodiment.

Referring again to FIGS. 10*a-b*, the arm 213 and/or the arm 211 also includes a number of sensors and associated electronics that are configured to measure and track a user's activities with the exercise device 200 and to calculate data, such as caloric expenditure, based on the user's activities and based on the number and/or type of resistance packs 210 coupled to the exercise device 200. As depicted in FIGS. 10*a* and 10*b*, a controller 227 is disposed inside the arm 213 between front 213F and rear 213R portions thereof. The controller 227 comprises a printed circuit board with a variety of available electronic components, such as processors, memory, wired and/or wireless input/output devices, and the like necessary for operation of the exercise device 200 as described below. Reference to the controller 227 herein is inclusive of these electronic components. Such electronic components are known in the art and are thus not described in detail herein.

The controller 227 may include an input/output (I/O) connector 229, such as a universal serial bus (USB) connector for coupling with a computing device for communicating data between the exercise device 200 and the computing device, e.g. data captured from one or more sensors disposed in the exercise device 200. The controller 227 may also include a wireless communications component for communicating data to/from the computing device via for example WiFi, BLUETOOTH, or other known wireless communication techniques, standards, and protocols.

The connector 229 may also be employed for coupling with a power source to charge a battery 231 disposed within the exercise device 200. Alternatively or in addition, a pair of electrical contacts 233 may be provided along an exterior surface of the exercise device 200 which may be employed for coupling to the power source. The electrical contacts 233 and the exercise device 200 may be configured for insertion into a rack or storage container that includes mating electrical contacts that electrically couple with the electrical contacts 233 to charge the battery 231 while disposed in the rack or storage container.

Optical sensors 235 can be provided on the controller 227 or otherwise disposed within the arm 213 and positioned to coincide with a slotted rib 255 formed on the arm 211. The optical sensors 235 are spaced apart a distance that is different than the spacing between the slots of the rib 255 such that optical sensors 235 sense the slots and/or tabs between the slots at different times as the slotted rib 255 is moved relative to the optical sensors 235 by pivoting of the arms 211, 213 relative to one another. Accordingly, the direction of movement of the slotted rib 255 and thus the arms 211, 213 can be determined as well as the speed or rate of movement. The slotted rib 255 can extend a distance sufficient to encompass the full range of motion of the arms 211, 213 relative to one another or may extend only a portion thereof. As depicted in FIG. 10*b*, the slotted rib 255 extends along substantially the full available range of motion between the arms 211, 213. As such, the direction, rate, and extent of the movements of the arms 211, 213 relative to one another can be sensed.

Although optical sensors and slots/tabs are employed in the embodiment described herein, it is understood that other types of sensors, including magnetic and/or electronic encoders, and detectable features might be employed to provide the same or similar function. For example, Hall-type magnetic sensors might be employed to detect magnets, magnetic pads, or indicia printed in magnetic inks arranged in a sensor strip or scale similarly to the slotted rib 255; electrical sensors might be employed to detect or electrically couple with features such as electrical contacts; or the optical sensors 235 might detect other features such as reflective pads, printed indicia, or other visual or optically detectable features arranged in a sensor strip or scale.

Because the arms 211, 213 are moved toward one another when both adducting ADD and abducting ABD forces are applied, the optical sensors 235 are unable to detect which force ADD, ABD is applied. Abduction sensors 257 may be provided that are configured to detect rotation of one or both of the pulleys 225. In another embodiment, the abduction sensors 257 may sense movement of one or both of the tension members 223 in addition to or instead of the pulleys 225. As depicted in FIGS. 10*a-b*, the abduction sensor 257 comprises a magnetic sensor or Hall-type sensor that detects one or more magnets 259 disposed in the pulley 225 as the magnets 259 pass the sensor 257 when the pulley 225 is rotated. The abduction sensor 257 can be employed to detect motion of the pulley 225 alone or to detect an distance of travel of the handgrips 221 based on the number of rotations of the pulley 225. Using the outputs from the abduction sensor 257, the controller 227 can determine whether the motion detected by the optical sensor 235 represents an abducting force ABD or an adducting force ADD; when a signal is received from optical sensor 235 but no signal is received from the abduction sensor 257 the motion is an adducting motion and when a signal is received from both the optical sensor 235 and the abduction sensor 257 then the motion is an abducting motion.

Figure 12A:
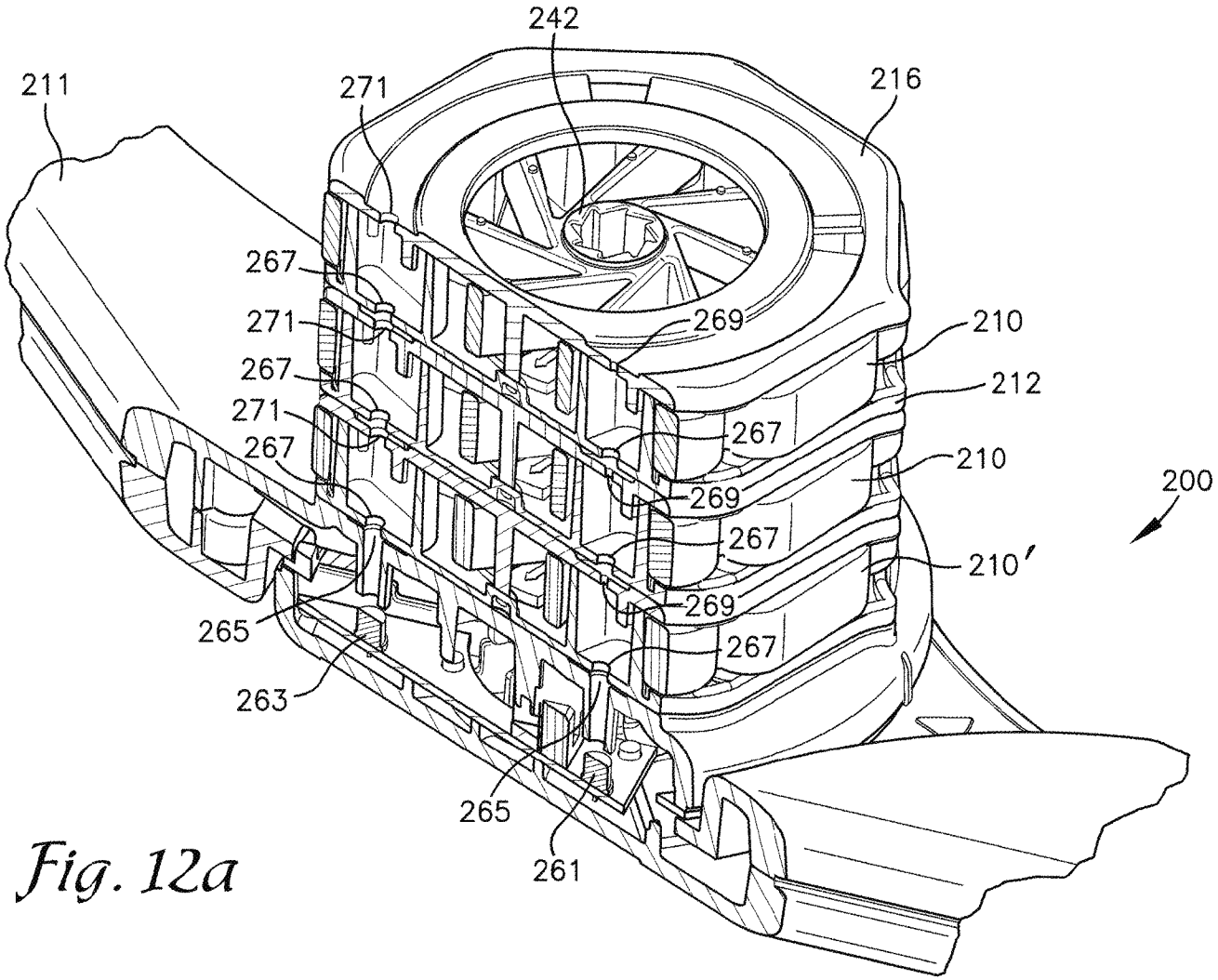
FIG. 12*a* is a cross-sectional view of the exercise device of FIG. 9 taken along the line 12-12 showing a resistance pack detection system that employs a light sensor depicted in accordance with an exemplary embodiment.
Figure 12B:
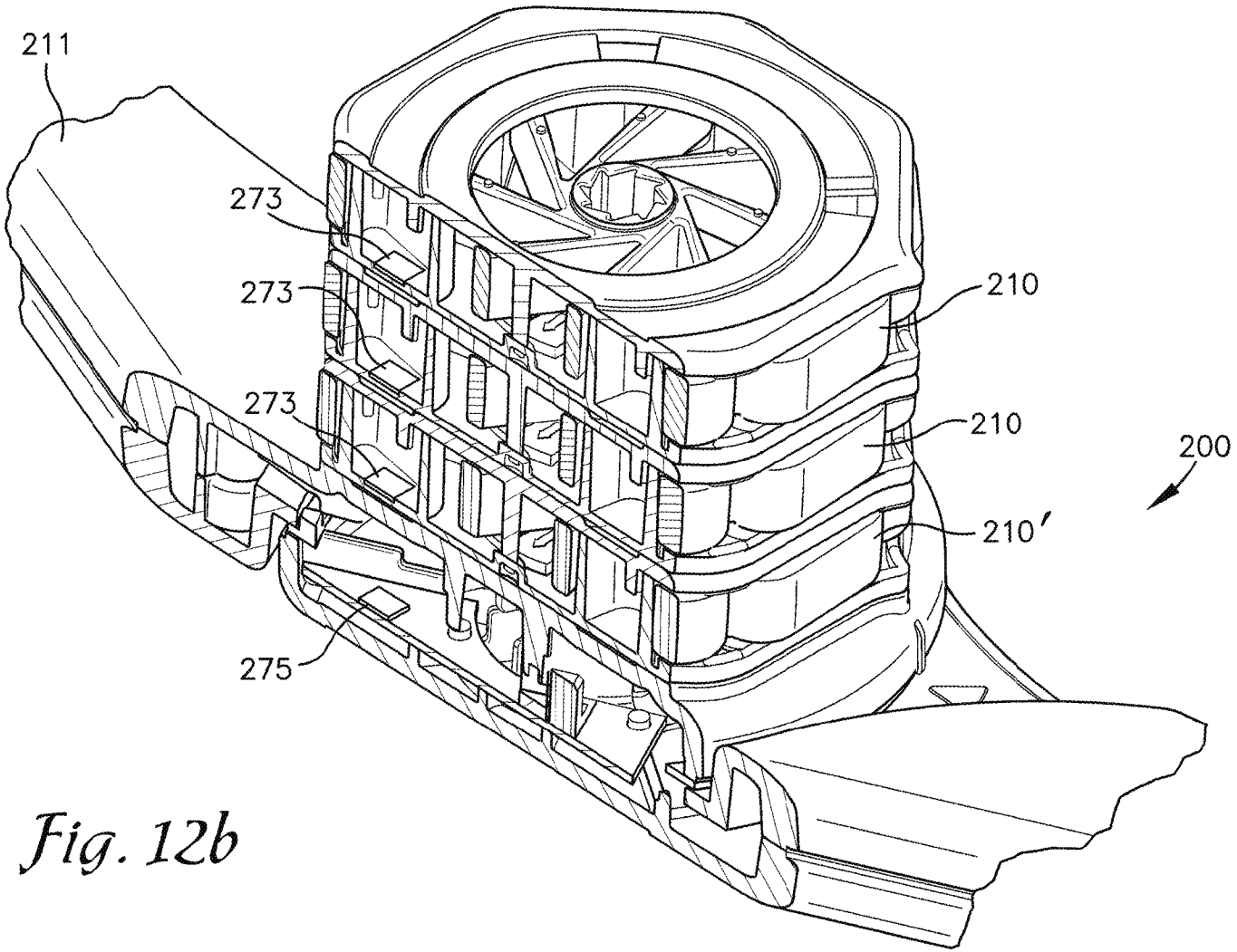
FIG. 12*b* is a cross-sectional view of the exercise device of FIG. 9 taken along the line 12-12 showing a resistance pack detection system that employs a radio frequency identification tag depicted in accordance with an exemplary embodiment.
Figure 12C:
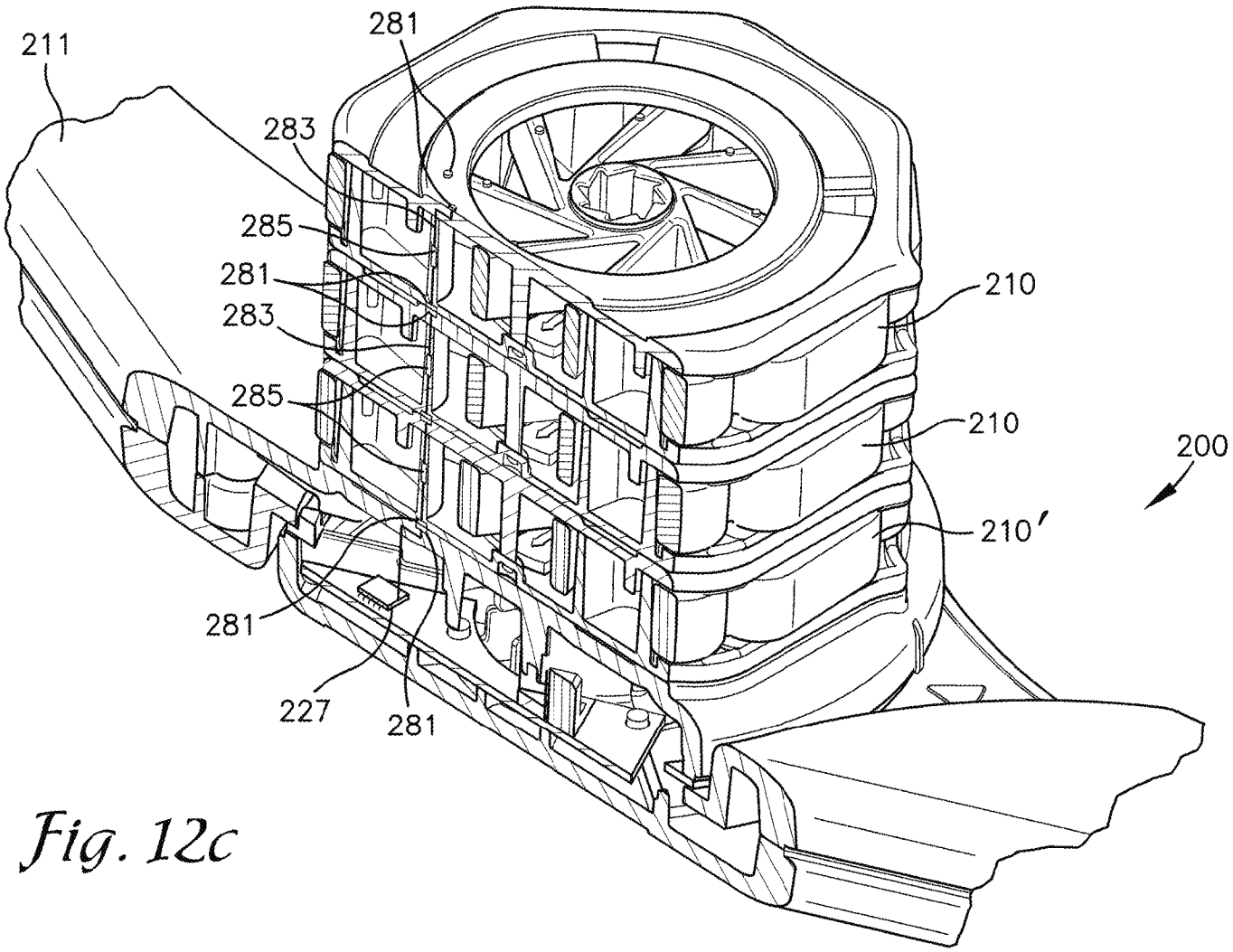
FIG. 12*c* is a cross-sectional view of the exercise device of FIG. 9 taken along the line 12-12 showing a resistance pack detection system that employs an electrical signal sensing system depicted in accordance with an exemplary embodiment.

With additional reference now to FIGS. 12*a-c*, sensors may also be provided to detect the presence, number, and/or identity of resistance packs 210 coupled to the exercise device 200. For example, a pair of light sensors 261, 263 may be provided interior to the arms 211, 213, e.g. on the printed circuit board of the controller 227, and within an area of a front portion 211F of the arm 211 on which the resistance pack 210 is received. The light sensors 261, 263 are aligned with respective apertures 265 in the front portion 211F. The apertures 265 both have a diameter, D, such that each sensor 261, 263 receives substantially the same amount of light from the environment when no resistance pack 210 is coupled to the exercise device 200.

Each of the resistance packs 210 includes a back plate 212 with a pair of back-plate apertures 267 having a diameter substantially equal to the diameter, D, of the apertures 265 in front portion of 211F and substantially aligned with respective ones of the apertures 265. Front plates 216 of the resistance packs 210 include a reference aperture 269 and a detection aperture 271 that align with respective ones of the back-plate apertures 267 and thus the apertures 265. The reference aperture 269 has a diameter substantially equal to the diameter, D, of the aperture 265 while the detection aperture 271 is smaller in diameter than the diameter D. The detection aperture 271 thus allows less environmental light to pass through than the reference aperture 269.

The presence of the resistance pack 210 coupled to the exercise device 200 is thus detectable by comparing the amount of environmental light detected by the sensor 261 (the reference sensor 261) to that detected by the sensor 263 (the detection sensor 263). When no resistance pack 210 is coupled to the exercise device 200, the amount of light detected by the reference sensor 261 and the detection sensor 263 is substantially the same or within a predetermined range. When a resistance pack 210 is coupled to the exercise device 200 the amount of light detected by the reference sensor 261 is detectably greater than the amount of light detected by the detection sensor 263 because the detection aperture 271 in the front plate 216 of the resistance pack 210 reduces the amount of light allowed to reach the detection sensor 263 as compared to that allowed through the reference aperture 269.

As additional resistance packs 210 are coupled to one another or stacked on the exercise device 200 (as depicted in FIG. 12*a*) the amount of light reaching the detection sensor 263 is further decreased as compared to that reaching the reference sensor 261. The degree of difference between the signals from the reference sensor 261 and the detection sensor 263 are defined to fall within a number of ranges which can be correlated to the number of resistance packs 210 coupled to the exercise device 200. The controller 227 can thus employ the signals provided by the sensors 261, 263 to determine the number of resistance packs 210 coupled to the exercise device 200.

In one embodiment, the reference sensor 261 is positioned on the exercise device 200 so as not to be overlapped by the resistance packs 210 and the resistance packs 210 do not include the reference aperture 269. As such, the amount of light detected by the reference sensor 261 is unaffected by the resistance packs 210. In another embodiment, instead of or in addition to altering the size of the detection aperture 271, the aperture 271 is provided with a filter that alters a characteristic of the environmental light passing therethrough; the altered characteristic is detectable by the detection sensor 263. In another embodiment, the reference sensor 261 is omitted and the light detected by the detection sensor 263 is compared to a predetermined reference level.

In another exemplary embodiment, a non-contact detection system with a detector 275 disposed in the exercise device 200 and a tag 273 disposed on or in each of the resistance packs 210 may be used, as depicted in FIG. 12*b*. For example, the tag 273 may comprise a radio-frequency identification (RFID) tag 273 that is provided in each resistance pack 210. The detector 275 may thus comprise an RFID reader 275 or interrogation device that is provided within the exercise device 200. The reader 275 can interrogate the tags 273 when the respective resistance packs 210 are coupled to the exercise device 200 to determine a number and/or identity of the resistance packs 210 being used. The identity of the resistance pack 210 may indicate a resistance level provided thereby, e.g. 10 pounds of resistance.

Alternatively, the detector 275 might comprise a sensor configured to detect the presence and/or strength of a magnetic field, such as a Hall-type sensor and the tag 273 might comprise a magnet. As such, the detector 275 can sense the magnetic field of the magnet/tag 273 when the resistance pack 210 is brought into sufficient proximity of the detector 275, e.g. coupled to the exercise device 200. Additional resistance packs 210 and tags magnets/tags 273 that are coupled to the exercise device 200 increase the magnitude of the magnetic field detected by the detector 275. The detected magnitude is then useable to determine a number of the resistance packs 210 that are coupled to the exercise device 200.

FIG. 12*c* depicts another embodiment in which the number of resistance packs 210 is detected through an electrical sensing method. Electrical contacts 281 may be provided on the front and back plates 216, 212 of the resistance packs 210 along with conductors 283 extending through the body of the resistance pack 210 and between respective ones of the contacts 281. Resistors 285 or similar electronic components may be disposed within each resistance pack 210 to affect the electrical circuit formed between the resistance packs 210 and the exercise device 200 in a detectable way, e.g. altering the resistance in the circuit. Contacts 287 are also provided on the front portion 211F of the arm 211 to contact and electrically couple with the contacts 287 on the back plate 212 and to connect the controller 227 with the circuit formed through the resistance packs 210. The controller 227 can thus determine the number of resistance packs 210 coupled to the exercise device 200 based on characteristics of the circuit such as a total resistance in the circuit among other measurable characteristics.

The controller 227 may also include a variety of additional sensors to aid operation of the exercise device 200. For example, one or more accelerometers 289 may be provided to sense movement of the exercise device 200 generally, e.g. sensing when a user picks up the device 200, not necessarily movement of the arms 211, 213 relative to one another. Such sensors may be employed to inform the controller 227 when to enter or exit a low power or power-saving mode.

Strain gages 291 might also be employed within the arms 211, 213 to determine when the arms 211, 213 are moved relative to one another and/or the amount of resistance applied by the resistance pack 210 based on flexure of the arms 211, 213. The strain gages 291 might be employed instead of or in addition to the optical sensors 235 to detect pivotal movement of the arms 211, 213. For example, pivotal movement of the arms 211, 213 under resistance provided by the resistance pack 210 applies a detectable strain or bending load on the arms 211, 213. The occurrence or application of this strain load can be detected by the strain gage 291 and used to identify when the arms 211, 213 are pivoted relative to one another.

The magnitude of the strain load might also be employed to detect the number and/or resistance level of resistance packs 210 coupled to the exercise device 200. The detected strain load applied to the arms 211, 213 may be correlated to the number of resistance packs 210 coupled to the exercise device 200 or to the resistance level provided by the resistance packs 210, e.g. ten pounds, five pounds, etc. The detected strain load can then be used to identify a number of resistance packs 210 coupled to the exercise device 200 or a resistance level provided thereby; the number of resistance packs 210 and the resistance level provided thereby may directly correlate, e.g. two resistance packs 210 may be equivalent to twenty pounds of resistance.

In one embodiment, the strain load varies over the range of pivotal movement of the arms 211, 213. The variation of the strain load may thus be employed to detect a range of motion through which the arms 211, 213 are moved. For example, the detected strain load can be used to determine if the arms 211, 213 are moved through a full pivotal range or some portion thereof.

With continued reference to FIGS. 9-12*a*, operation of the exercise device 200 is described in accordance with an exemplary embodiment. Initially, the exercise device 200 may not have a resistance pack 210 coupled thereto. In such a state, the arms 211, 213 of the exercise device 200 may be pivoted toward one another without resistance to facilitate storage of the device 200. The controller 227 may sense movement or lack of movement of the exercise device 200 via one or more accelerometers 289. The controller 227 may place electronics within the exercise device 200 in a low-power mode when no movement is detected for a predetermined time period and can wake up or place the electronics in an active powered-on state when movement is detected to conserve battery power.

In the active state, the controller 227 may detect the position of the arms 211, 213 via, for example, the optical sensors 235. Upon reaching full extension of the arms 211, 213 to a maximum angle therebetween, a light-emitting diode (LED) 292 may be illuminated to indicate to a user that the exercise device 200 is properly positioned to receive a first resistance pack 210 thereon. The resistance pack 210 is coupled to the front portion 211F of the arm 211 by engaging hooks 234 on the back plate 212 of the resistance pack 210 with slots 222 formed in the front portion 211F of the arm 211 in manner similar to that described previously above with respect to the resistance packs 10 and 110. As described previously, engagement of the hooks 234 with the slots 222 also engages a hub 242 of the resistance pack 210 with the axle 215 in the exercise device 200.

The exercise device 200 may be configured to require a particular first resistance pack 210' to be coupled to the exercise device 200 directly while any remaining resistance packs 210 can be coupled in any order to one another and to the first resistance pack 210'. To prevent other resistance packs 210 from being coupled directly to the exercise device 200 instead of the first resistance pack 210', the hooks 234 and the slots 222 may be spaced differently or the hub 242 of the resistance pack 210' may be configured differently than that of the remaining resistance packs 210, among other methods. In one embodiment, the first resistance pack 210' provides a greater resistance than each of the remaining resistance packs 210. Such may be preferable to ensure that at least a minimum resistance is provided to movement of the arms 211, 213 of the exercise device 200. For example, it is preferable to provide a resistance sufficient to return the arms 211, 213 to their fully extended position when released by the user.

After coupling the first resistance pack 210' to the exercise device 200, one or more additional resistance packs 210 may be coupled to or stacked on the first resistance pack 210 to provide a desired resistance. The controller 227 employees the sensors 261, 263 to determine the number of resistance packs 210', 210 coupled to the exercise device 200 by comparing the amount of environmental light received by the reference sensor 261 to that received by the detection sensor 263.

The user performs one or more exercises using the exercise device 200 by applying an adducting force ADD or an abducting force ABD to the handgrips 221 and thus to the arms 211, 213. Using the optical sensors 235 and the slotted rib 255, the controller 227 detects and tracks relative movements of the arms 211, 213, and one or more of their direction, rate, and extent. The controller 227 also employs the abduction sensor 257 and the magnets 259 disposed in the pulleys 225 to determine whether the movements of the arms 211, 213 are abducting or adducting movements. The abduction sensor 257 may also be employed to determine the extent of the abducting movements.

Based on data collected from the sensors 235, 257 and/or others, the controller 227 may track and/or calculate a variety of data elements associated with the user's performance of the exercises. For example, a number of repetitions, a type of movement (abduction or adduction), a resistance used, a caloric expenditure, and an amount of work performed, among other data. This data can be calculated by the controller 227 or the collected data can be stored and/or communicated to a separate computing device, such as a personal computer, smart phone, tablet computer, or other portable or non-portable computing device for storage or operation thereon. The data can be communicated wirelessly, such as via WiFi or Bluetooth, or a communication cable 293 can be coupled with the controller 227 via the input/output connector 229.

The computing device may comprise a smart phone or similar portable device executing an application that presents the data to the user. The application may provide other functions associated with the data and/or the exercises performed such as tracking performance, calculating caloric expenditure, providing information regarding exercises to be performed, proper form for the exercises, diet, and motivation, among others.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A resistance pack for an exercise device, the resistance pack comprising:

a body including a first obstruction feature;

a resistance element disposed on the body, the resistance element having a hub with a plurality of elastomeric spokes extending outwardly therefrom, the hub being rotatable relative to the body, and distal ends of the plurality of elastomeric spokes being engaged with the body to resist movement of the distal ends of the plurality of elastomeric spokes relative to the body; and a second obstruction feature coupled to the hub and rotatable with the hub relative to the body, the second obstruction feature extending a radial distance outward from the hub to engage the first obstruction feature on the body, wherein the radial distance is located within the resistance pack between the hub and the distal ends of the plurality of elastomeric spokes the second obstruction feature being on a first side of the first obstruction feature in an initial position in which the plurality of elastomeric spokes are in a non-tensioned state, the hub being rotatable relative to the body to move the second obstruction feature past the first obstruction feature in a first rotational direction to a preloaded position in which the plurality of elastomeric spokes are in a tensioned state, the first obstruction feature engaging the second obstruction feature and resisting movement of the second obstruction feature and the hub in an opposite second rotational direction back to the initial position.

2. The resistance pack of claim 1, wherein the first obstruction feature comprises a raised tab disposed on a surface of the body, the tab including a sloped surface and a stop surface, the sloped surface aiding movement of the second obstruction feature over the tab in the first direction and the stop surface resisting movement of the second obstruction feature over the tab in the second direction.

3. The resistance pack of claim 1, further comprising:

a back plate forming a first portion of the body;

a plurality of coupling arms extending from an exterior surface of the back plate, each coupling arm including a hook on a distal end thereof, the hook on each of the plurality of coupling arms extending from the respective coupling arm in a corresponding rotational direction, and each of the hooks including a sloped top edge and a sloped bottom edge that come together to form a point;

a front plate forming a second portion of the body and including a plurality of slots formed therein, the plurality of slots being sized and positioned to respectively receive a plurality of coupling arms of a second similarly configured resistance pack, hooks on the plurality of coupling arms of the second similarly configured resistance pack respectively engaging the plurality of slots to releasably couple the two resistance packs together.

4. The resistance pack of claim 1, wherein the second obstruction feature flexes to move past the first obstruction feature in the first rotational direction to the preloaded position.

* * * * *